US010151429B2

(12) United States Patent
Weitz et al.

(10) Patent No.: US 10,151,429 B2
(45) Date of Patent: Dec. 11, 2018

(54) RAPID PRODUCTION OF DROPLETS

(71) Applicant: President and Fellows of Harvard College, Cambridge, MA (US)

(72) Inventors: David A. Weitz, Bolton, MA (US); Esther Amstad, Cambridge, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 134 days.

(21) Appl. No.: 14/890,817

(22) PCT Filed: May 14, 2014

(86) PCT No.: PCT/US2014/037962
§ 371 (c)(1),
(2) Date: Nov. 12, 2015

(87) PCT Pub. No.: WO2014/186440
PCT Pub. Date: Nov. 20, 2014

(65) Prior Publication Data
US 2016/0091145 A1 Mar. 31, 2016

Related U.S. Application Data

(60) Provisional application No. 61/823,175, filed on May 14, 2013.

(51) Int. Cl.
*F17D 1/20* (2006.01)
*F15D 1/02* (2006.01)
(Continued)

(52) U.S. Cl.
CPC ..... *F17D 1/20* (2013.01); *B01F 3/0807* (2013.01); *B01F 5/0478* (2013.01);
(Continued)

(58) Field of Classification Search
CPC ..... F17D 1/20; F15D 1/02; B01F 3/0807
See application file for complete search history.

(56) References Cited

U.S. PATENT DOCUMENTS 7,132,650 B1 * 11/2006 Gamble et al. .... G01N 30/7233 137/625.46
2005/0167370 A1 8/2005 Nakajima et al.
(Continued)

FOREIGN PATENT DOCUMENTS

CN 1453366 A 11/2003
CN 2596359 Y 12/2003
(Continued)

OTHER PUBLICATIONS

International Search Report and Written Opinion for Application No. PCT/US2014/037962 dated Nov. 17, 2014.
(Continued)

*Primary Examiner* — Kevin Lee
(74) *Attorney, Agent, or Firm* — Wolf, Greenfield & Sacks, P.C.

(57) ABSTRACT

The present invention generally relates to the production of fluidic droplets. Certain aspects of the invention are generally directed to systems and methods for creating droplets by flowing a fluid from a first channel to a second channel through a plurality of side channels. The fluid exiting the side channels into the second channel may form a plurality of droplets, and in some embodiments, at very high droplet production rates. In addition, in some aspects, double or higher-order multiple emulsions may also be formed. In some embodiments, this may be achieved by forming multiple emulsions through a direct, synchronized production method and/or through the formation of a single emulsion that is collected and re-injected into a second microfluidic device to form double emulsions.

22 Claims, 30 Drawing Sheets

(51) Int. Cl.

| | |
|---|---|
| ***B01L 3/02*** | (2006.01) |
| ***B01L 3/00*** | (2006.01) |
| ***B01F 13/00*** | (2006.01) |
| ***B01F 5/04*** | (2006.01) |
| ***B01F 3/08*** | (2006.01) |

(52) U.S. Cl.

CPC ..... *B01F 13/0059* (2013.01); *B01F 13/0061* (2013.01); *B01L 3/0241* (2013.01); *B01L 3/502784* (2013.01); *F15D 1/02* (2013.01); *B01F 2215/0431* (2013.01); *B01L 2200/0673* (2013.01); *B01L 2300/0816* (2013.01)

(56) References Cited

U.S. PATENT DOCUMENTS

| | | | |
|---|---|---|---|
| 2007/0099290 | A1 | 5/2007 | Iida et al. |
| 2008/0104975 | A1 | 5/2008 | Gorbounov et al. |
| 2009/0042241 | A1 | 2/2009 | Yu-Chong et al. |

FOREIGN PATENT DOCUMENTS

| | | | |
|---|---|---|---|
| CN | 1483580 | A | 3/2004 |
| CN | 201004062 | Y | 1/2008 |
| CN | 101120222 | A | 2/2008 |
| CN | 101678356 | A | 3/2010 |

OTHER PUBLICATIONS

International Preliminary Report on Patentability for Application No. PCT/US2014/037962 dated Nov. 26, 2015.

Kobayashi et al., Microchannel emulsification for mass production of uniform fine droplets: integration of microchannel arrays on a chip, Microfluid Nanofluid (2010) 8: 255. doi: 10.1007/s10404-009-0501-y, Sep. 2009.

Chinese Office Action dated Aug. 24, 2016 for Application No. CN 201480040033.7.

Chinese Office Action dated May 9, 2017 for Application No. CN 201480040033.7.

Office Communication dated Apr. 20, 2017 for Application No. EP 14730349.9.

* cited by examiner

RAPID PRODUCTION OF DROPLETS

RELATED APPLICATIONS

This application is a national stage filing under 35 U.S.C. § 371 of International Application No. PCT/US2014/037962, filed May 14, 2014, entitled "Rapid Production of Droplets," which claims the benefit of U.S. Provisional Patent Application Ser. No. 61/823,175, filed May 14, 2013, entitled "Rapid Production of Droplets," each incorporated herein by reference in its entirety.

GOVERNMENT FUNDING

This invention was made with government support under Grant Nos. DMR-0820484 and DMR-1006546 awarded by the National Science Foundation. The government has certain rights in the invention.

FIELD

The present invention generally relates to the production of fluidic droplets.

BACKGROUND

Emulsions are ubiquitous in daily life; many food products such as milk, mayonnaise or salad dressing and certain types of paints are emulsions. Droplets of single emulsions can also serve as templates to fabricate microparticles that serve as carriers for delivery purposes or building blocks of hierarchical 2D and 3D materials. Especially if used as templates to fabricate microparticles or capsules, it is important to closely control the size and composition of droplets. The extent to which these parameters can be controlled is determined by the assembly route; the most widely used techniques include bulk emulsification, membrane filtration and microfluidic assembly. Bulk emulsification techniques allow for the production of emulsion at a high throughput rendering them attractive for industrial applications. However, the control over the size of the resulting droplets is poor resulting in a broad size distribution. By contrast, microfluidic techniques enable the assembly of monodisperse droplets with a good control over their size; this is achieved through the controlled formation of a single droplet per time and droplet maker. However, this comes at the expense of relatively low throughput.

The low throughput limits the applicability of microfluidic technologies in industry and to produce microparticle building blocks for the assembly of new types of hierarchical 2D and 3D material despite that they offer superior control over the size and composition of droplets. For many applications, membrane emulsification techniques present an attractive compromise; their throughput is considerably higher than that achieved with microfluidic techniques while the size distribution of droplets is significantly lower than that of droplets produced through bulk emulsification routes. However, the polydispersity of droplets produced through membrane emulsification techniques increases with increasing average size of the droplets. Thus, the production of monodisperse droplets at a high throughput is still a major challenge.

SUMMARY

The present invention generally relates to the production of fluidic droplets. The subject matter of the present invention involves, in some cases, interrelated products, alternative solutions to a particular problem, and/or a plurality of different uses of one or more systems and/or articles.

In one aspect, the present invention is generally directed to an apparatus, for example, a microfluidic apparatus. In accordance with one set of embodiments, the apparatus a first microfluidic channel, a second microfluidic channel, and at least five side microfluidic channels each connecting the first microfluidic channel with the second microfluidic channel. In some embodiments, the first microfluidic channel has a cross-sectional area at least 20 times greater than the smallest cross-sectional area of the at least five side channels.

The apparatus, according to another set of embodiments, includes a first, microfluidic channel having a length of at least about 5 mm, a second microfluidic channel substantially parallel to the first microfluidic channel, and at least five side microfluidic channels each connecting the first microfluidic channel with the second microfluidic channel.

In yet another set of embodiments, the apparatus comprises a first microfluidic channel having a length of at least about 5 mm, a second microfluidic channel, at least five side microfluidic channels each connecting the first microfluidic channel with the second microfluidic channel, a third microfluidic channel, and at least five side microfluidic channels each connecting the second microfluidic channel with the third microfluidic channel.

The apparatus, in still another set of embodiments, includes a first microfluidic channel, second microfluidic channel, at least five side microfluidic channels each connecting the first microfluidic channel with the second microfluidic channel, and a plurality of auxiliary microfluidic channels connecting to each of the at least five side microfluidic channels.

In another set of embodiments, the apparatus includes a first microfluidic channel, a second microfluidic channel, and at least five side microfluidic channels each connecting the first microfluidic channel with the second microfluidic channel. In some cases, each of the at least five side channels has a length of between about 90% and about 110% of the average length of the side channels.

The apparatus, according to another set of embodiments, includes a first microfluidic channel, a second microfluidic channel, and at least five side microfluidic channels each connecting the first microfluidic channel with the second microfluidic channel. In certain embodiments, each of the at least five side channels has a cross-sectional area of between about 90% and about 110% of the average cross-sectional area of the side channels.

In accordance with yet another set of embodiments, the apparatus comprises a first microfluidic channel, a second microfluidic channel, and at least five side microfluidic channels each connecting the first microfluidic channel with the second microfluidic channel. In some cases, each of the at least five side channels has a volume of between about 90% and about 110% of the average volume of the side channels.

The apparatus, in still another set of embodiments, includes a first microfluidic channel, a second microfluidic channel, and at least five microfluidic side channels, each having substantially the same dimensions, each connecting the first microfluidic channel with the second fluidic channel.

In another aspect, the present invention is generally directed to a method. In one set of embodiments, the method includes flowing a first fluid in a first microfluidic channel through at least five side microfluidic channels into a second fluid contained in a second microfluidic channel. In some cases, the first fluid forms a plurality of droplets within the second microfluidic channel, the droplets each having an characteristic dimension of between about 90% and about 110% of the average characteristic dimension of the plurality of droplets.

In another set of embodiments, the method includes an act of flowing a first fluid in a first microfluidic channel through at least five side microfluidic channels into a second fluid contained in a second microfluidic channel. In some cases, each of the at least five side channels has a resistance to flow of the first fluid of between about 90% and about 110% of the average resistance to flow of the first fluid through the side channels.

The method, in still another set of embodiments, includes acts of flowing a first fluid in a first microfluidic channel through at least five side microfluidic channels into a second fluid contained in a second microfluidic channel, where the first fluid forms a plurality of droplets within the second microfluidic channel, and flowing the plurality of droplets containing within the second microfluidic channel through at least five side microfluidic channels into a third fluid contained in a third microfluidic channel, where the plurality of droplets form a plurality of double emulsion droplets contained within the third fluid.

According to yet another set of embodiments, the method includes an act of flowing a first fluid in a first microfluidic channel through at least five side microfluidic channels into a second fluid contained in a second microfluidic channel while flowing a third fluid into each of the at least five side channels. In certain embodiments, the first fluid forms droplets surrounded by the third fluid and the third fluid forms droplets surrounded by the second fluid.

In another aspect, the present invention encompasses methods of making one or more of the embodiments described herein, for example, an apparatus as discussed herein. In still another aspect, the present invention encompasses methods of using one or more of the embodiments described herein, for example, an apparatus as discussed herein.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

The present invention generally relates to the production of fluidic droplets. Certain aspects of the invention are generally directed to systems and methods for creating droplets by flowing a fluid from a first channel to a second channel through a plurality of side channels. The fluid exiting the side channels into the second channel may form a plurality of droplets, and in some embodiments, at very high droplet production rates. In addition, in some aspects, double or higher-order multiple emulsions may also be formed. In some embodiments, this may be achieved by forming multiple emulsions through a direct, synchronized production method and/or through the formation of a single emulsion that is collected and re-injected into a second microfluidic device to form double emulsions.

Figure 1A:
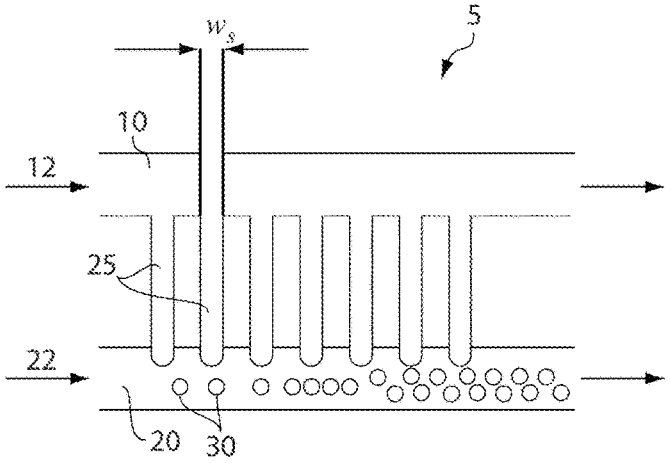
FIGS. 1A-1C illustrate various apparatuses, in accordance with certain embodiments of the invention.

One example of an embodiment of the invention is now described with respect to FIG. 1A. As will be discussed in more detail below, in other embodiments, other configurations may be used as well. In FIG. 1, apparatus 5 comprises a first channel 10, a second channel 20, and a plurality of side channels 25 each connecting the first channel with the second channel. Some or all of these channels may be microfluidic. A first fluid 12 may enter through first channel 10 while a second fluid 22 enters through second channel 20. The first fluid can flow through the side channels to enter second channel 20. If the first fluid and the second fluid are at least substantially immiscible, the first fluid exiting the side channels may form individual droplets within the second channel, as is shown by droplets 30. In addition, in certain embodiments, the first fluid itself may contain an emulsion.

The side channels, in some cases, may each have substantially the same dimensions, e.g., they may have substantially the same volume, cross-sectional area, length, shape, etc. For example, each of first channel 10 and second channel 20 may be substantially straight and parallel, and/or the first and second channels may not necessarily be straight but the channels may have a relatively constant distance of separation therebetween, such that some or all of the side channels have substantially the same shape or other dimensions while connecting the first channel with the second channel.

As mentioned, fluid passing from the first channel through the side channels, and entering the second channel, may form a plurality of droplets of first fluid contained within the second fluid. In some cases, the droplets may have substantially the same size or characteristic dimension, for example, if the side channels have substantially the same cross-sectional area and/or length and/or other dimensions. In such a way, a plurality of substantially monodisperse droplets may be formed, in accordance with certain embodiments of the invention.

Figure 8:
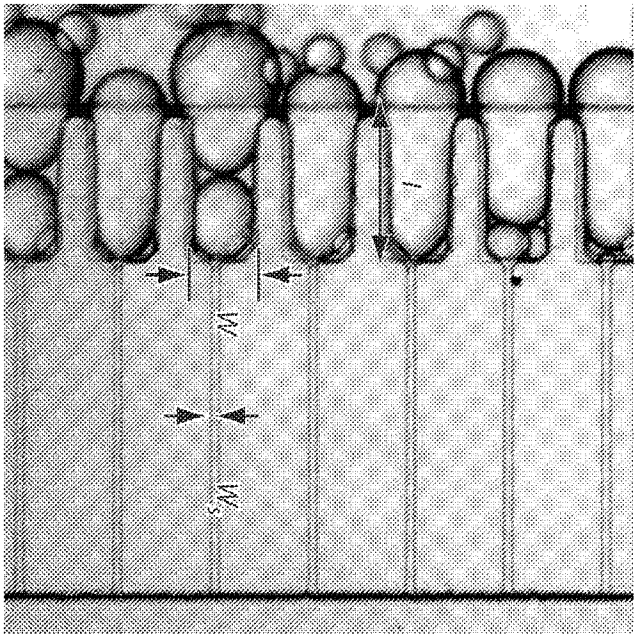
FIG. 8 illustrates microfluidic channels in another embodiment of the invention.

However, although the side channels are shown in FIG. 1A are shown as being straight, with constant cross-sectional area, this is by way of example only, and in other embodiments, the side channels need not be straight, and/or the side channels may not necessarily have a constant cross-sectional area. For example, the side channels may have different cross-sectional areas at different locations within the channels. In addition, other channels may be present in connection with these channels in certain embodiments, for example, as is shown in FIG. 8. Furthermore, although the side channels are illustrated as being regularly periodically spaced in FIG. 1A, this is not a requirement, and other spacings of the side channels are also possible in other cases. For example, in one set of embodiments, the spacings between adjacent channels may be substantially the same, and/or the cross-sectional dimension or area of the side channels may be substantially the same size to create droplets that have substantially the same size or characteristic dimension, e.g., as is discussed herein.

In one set of embodiments, the minimum cross-sectional area of the side channels is substantially smaller than the cross-sectional area of the first or second channels. For example, the first channel may have a cross-sectional area at least 10 times larger than the smallest cross-sectional area of the side channels. In some cases, the height of the first channel and the height of the side channels may be different, e.g., to produce such differences in cross-sectional area. Other ratios or configurations are discussed in detail below. Without wishing to be bound by any theory, it is believed that since the cross-sectional area of the side channels is substantially smaller than the cross-sectional area of the first or second channels, the resistance to fluid flow is largely dominated by the dimensions of the side channels, rather than the dimensions of the first or second channels. Accordingly, if the side channels have substantially the same dimensions, the side channels should each produce substantially the same resistance to fluid flow, and accordingly, produce droplets are substantially the same. Thus, by controlling factors such as the overall pressure drop across the side channels to be substantially constant, a plurality of substantially monodisperse droplets may be produced, at least according to some embodiments of the invention.

In addition, it should be noted that since fluid flow resistance is a major factor in droplet production in some embodiments, other factors such as the viscosity of the continuous phase have less of an effect on droplet production. For example, as is shown in FIG. 21, the viscosity of the continuous phase does not substantially the average droplet size, although the droplets may increase in polydispersity.

It should also be understood that the first channel and the second channel may be of any suitable length. In some embodiments, relatively long channels may be used, e.g., such that a relatively large number of side channels may be present between the first and second channels, which may be used to produce relatively large numbers of droplets and/or to produce droplets at relatively large rates. For example, there may be at least 100, 500, 1,000, etc. side channels present between the first channel and the second channel. In addition, in certain embodiments, the first and/or second channels may have a length of at least 1 mm, at least 5 mm, at least 1 cm, at least 2 cm, at least 3 cm, etc.

Furthermore, while only two channels are shown in FIG. 1A, this is for explanatory purposes only. Other channels and/or other configurations are also possible in other embodiments of the invention. For instance, in FIG. 1B, besides first channel 10, second channel 20, and side channels 25, a third channel 30 is present on the opposite side of first channel, connected by additional side channels each connecting the first channel with the third channel. These side channels may be the same or different as the side channels connecting the first channel with the second channel, and may be used to further increase the number and/or rate of droplets that are produced.

The above discussion is a non-limiting example of one embodiment of the present invention that can be used to produce droplets. However, other embodiments are also possible. Accordingly, more generally, various aspects of the invention are directed to various systems and methods for droplets, as discussed below.

One aspect of the present invention is generally directed to systems or apparatuses for producing droplets. The droplets may be relatively monodisperse in some instances. In one set of embodiments, the droplets are produced by flowing a first fluid from a first channel, through a plurality of side channels, to a second fluid contained within a second channel. The first channel, the second channel, and the side channels may be microfluidic channels in various embodiments of the invention, although they need not all be microfluidic in some cases. Examples and details of various properties of the microfluidic channels are presented in more detail below, e.g., sizes, dimensions, optional coatings, etc. In addition, the first fluid and the second fluid may be substantially immiscible in some cases, as discussed below.

The first channel for containing the first fluid may be of any suitable length. In one set of embodiments, the first channel is substantially straight, e.g., as viewed visually. However, in other embodiments, the first channel may contain one or more curves, bends, or the like. In some cases, the first channel may have a serpentine or a spiral configuration. In addition, in some embodiments, the first channel may include one or more branches, some or all of which may contain side channels connecting the first channel with a second channel (or more than one second channel, in some embodiments). The first channel can also be connected to a source of fluid (e.g., a first fluid), as discussed herein.

The first channel may have any suitable length. In some cases, the length of the channel may be measured to include regions of the first channel containing the side channels connecting the first channel with one or more second channels, including branches of the first channel. Thus, for example, if the first channel has a "Y" or a "T" configuration, the total length of the first channel may include both branches, if both branches each contain side channels. In one set of embodiments, the total length of the first channel, containing the side channels, may be at least about 1 mm, at least about 2 mm, at least about 3 mm, at least about 5 mm, at least about 7 mm, at least about 1 cm, at least about 1.5 cm, at least about 2 cm, at least 2.5 cm, at least about 3 cm, at least about 5 cm, at least about 7 cm, at least about 10 cm, etc. In some cases, however, the total length of the first channel, containing the side channels, may be no more than about 10 cm, no more than about 7 cm, no more than about 5 cm, no more than about 3 cm, no more than about 2.5 cm, no more than about 2 cm, no more than about 1.5 cm, no more than about 1 cm, no more than about 7 mm, no more than about 5 mm, no more than about 3 mm, or no more than about 2 mm. Combinations of any of these are also possible in some cases.

The cross-sectional area of the first channel may be substantially constant, or may vary in some embodiments, e.g., as a function of position in the direction of fluid flow within the first channel. The average cross-sectional area of the first channel may be, according to one set of embodiments, at least about 1,000 micrometers$^2$, at least about 2,000 micrometers$^2$, at least about 3,000 micrometers$^2$, at least about 5,000 micrometers$^2$, at least about 10,000 micrometers$^2$, at least about 20,000 micrometers$^2$, at least about 30,000 micrometers$^2$, at least about 50,000 micrometers$^2$, at least about 100,000 micrometers$^2$, at least about 200,000 micrometers$^2$, at least about 300,000 micrometers$^2$, at least about 500,000 micrometers$^2$, at least about 1,000,000 micrometers$^2$, or the like. However, in some cases, the average cross-sectional area of the second channel may be no more than about 1,000,000 micrometers$^2$, no more than about 500,000 micrometers$^2$, no more than about 300,000 micrometers$^2$, no more than about 200,000 micrometers$^2$, no more than about 100,000 micrometers$^2$, no more than about 50,000 micrometers$^2$, no more than about 30,000 micrometers$^2$, no more than about 20,000 micrometers$^2$, no more than about 10,000 micrometers$^2$, no more than about 5,000 micrometers$^2$, no more than about 3,000 micrometers$^2$, or no more than about 2,000 micrometers$^2$. Combinations of any of these areas are also possible. In certain embodiments, the cross-sectional area of the first channel may vary, e.g., along with the length of the channel. However, in some embodiments, the first channel may have a cross-sectional area that varies between about 75% and about 125%, between about 80% and about 120%, between about 90% and about 110%, between about 95% and about 105%, between about 97% and about 103%, or between about 99% and about 101% of the average cross-sectional area. In addition, the first channel may have any suitable cross-sectional shape, e.g., circular, oval, triangular, irregular, square or rectangular, or the like.

The first channel may also have any suitable maximal cross-sectional dimension, i.e., the largest dimension that can be contained within a cross-section of the first channel, where the cross-section is determined orthogonal to the direction of average fluid flow within the first channel. For example, the maximum cross-sectional dimension may be no more than 1 mm, no more than about 800 micrometers, no more than about 600 micrometers, no more than about 500 micrometers, no more than about 400 micrometers, no more than about 300 micrometers, no more than about 250 micrometers, no more than about 200 micrometers, no more than about 100 micrometers, no more than about 75 micrometers, no more than about 50 micrometers, no more than about 25 micrometers, no more than about 10 micrometers, etc. In addition, in some cases, the maximum cross-sectional dimension may be at least about 5 micrometers, at least about 10 micrometers, at least about 25 micrometers, at least about 50 micrometers, at least about 75 micrometers, at least about 100 micrometers, at least about 200 micrometers, at least about 250 micrometers, at least about 300 micrometers, at least about 400 micrometers, at least about 500 micrometers, at least about 600 micrometers, at least about 800 micrometers, etc. In addition, in certain embodiments, combinations of these maximum cross-sectional dimensions are also possible.

The first channel (e.g., as is discussed herein) may be in fluidic communication with a second channel, or more than one second channel, in some cases. Like the first channel, the second channel may also be microfluidic, although in some embodiments, one or both of the first and second channels is not microfluidic. Non-limiting examples of various properties of microfluidic channels are discussed in more detail below.

In one set of embodiments, the second channel is separated from the first channel by a relatively constant distance of separation, and/or the first channel and the second channel may be substantially parallel to each other. In one set of embodiments, the first channel and the second channel have a distance of separation that is between about 75% and about 125% of the average distance of separation between the channels. The distance of separation may also vary between about 80% and about 120%, between about 90% and about 110%, between about 95% and about 105%, between about 97% and about 103%, or between about 99% and about 101% in other embodiments.

In some cases, as mentioned, more than one second channel may be present. Each of the second channels may be in fluidic communication with the first channel, e.g., through one or more side channels as is discussed herein. If more than one second channel is present, each of the second channels may be at the same or different distances as the first channel. In addition, the second channels may have the same or different lengths, shapes, cross-sectional areas, or other properties. The second channels also may or may not be fluidly connected to each other.

A second channel may be of any suitable length. In one set of embodiments, the second channel is substantially straight, e.g., as viewed visually. However, in other embodiments, the second channel may contain one or more curves, bends, or the like, similar to the first channel. In some cases, the shape of the second channel may be substantially the same as the shape of the first channel, e.g., such that the second channel is separated from the first channel by a relatively constant distance of separation. However, in other cases, the second channel may have a different shape.

A second channel may have any suitable length. The length may be substantially the same as the first channel, in some cases. In some cases, the length of the channel may be measured to include regions of the second channel containing the side channels connecting the first channel with one or more second channels. In one set of embodiments, the total length of the second channel, containing the side channels, may be at least about 1 mm, at least about 2 mm, at least about 3 mm, at least about 5 mm, at least about 7 mm, at least about 1 cm, at least about 1.5 cm, at least about 2 cm, at least 2.5 cm, at least about 3 cm, at least about 5 cm, at least about 7 cm, at least about 10 cm, etc. In some cases, however, the total length of the second channel, containing the side channels, may be no more than about 10 cm, no more than about 7 cm, no more than about 5 cm, no more than about 3 cm, no more than about 2.5 cm, no more than about 2 cm, no more than about 1.5 cm, no more than about 1 cm, no more than about 7 mm, no more than about 5 mm, no more than about 3 mm, or no more than about 2 mm. Combinations of any of these are also possible in some cases.

The cross-sectional area of the second channel may be substantially constant, or may vary in some embodiments, e.g., as a function of position in the direction of fluid flow within the second channel. The average cross-sectional area of the second channel may be, according to one set of embodiments, at least about 1,000 micrometers$^2$, at least about 2,000 micrometers$^2$, at least about 3,000 micrometers$^2$, at least about 5,000 micrometers$^2$, at least about 10,000 micrometers$^2$, at least about 20,000 micrometers$^2$, at least about 30,000 micrometers$^2$, at least about 50,000 micrometers$^2$, at least about 100,000 micrometers$^2$, at least about 200,000 micrometers$^2$, at least about 300,000 micrometers$^2$, at least about 500,000 micrometers$^2$, at least about 1,000,000 micrometers$^2$, or the like. However, in some cases, the average cross-sectional area of the second channel may be no more than about 1,000,000 micrometers$^2$, no more than about 500,000 micrometers$^2$, no more than about 300,000 micrometers$^2$, no more than about 200,000 micrometers$^2$, no more than about 100,000 micrometers$^2$, no more than about 50,000 micrometers$^2$, no more than about 30,000 micrometers$^2$, no more than about 20,000 micrometers$^2$, no more than about 10,000 micrometers$^2$, no more than about 5,000 micrometers$^2$, no more than about 3,000 micrometers$^2$, or no more than about 2,000 micrometers$^2$. Combinations of any of these areas are also possible. In certain embodiments, the cross-sectional area of the second channel may vary, e.g., along with the length of the channel. However, in some embodiments, the second channel may have a cross-sectional area that varies between about 75% and about 125%, between about 80% and about 120%, between about 90% and about 110%, between about 95% and about 105%, between about 97% and about 103%, or between about 99% and about 101% of the average cross-sectional area. The cross-sectional area of the second channel may be the same or different than the cross-sectional area of the first channel. In addition, the second channel may have any suitable cross-sectional shape, e.g., circular, oval, triangular, irregular, square or rectangular, or the like. The cross-sectional shape of the second channel may be the same or different than the cross-sectional shape of the first channel.

The second channel may also have any suitable maximal cross-sectional dimension, i.e., the largest dimension that can be contained within a cross-section of the second channel, where the cross-section is determined orthogonal to the direction of average fluid flow within the second channel. For example, the maximum cross-sectional dimension may be no more than 1 mm, no more than about 800 micrometers, no more than about 600 micrometers, no more than about 500 micrometers, no more than about 400 micrometers, no more than about 300 micrometers, no more than about 250 micrometers, no more than about 200 micrometers, no more than about 100 micrometers, no more than about 75 micrometers, no more than about 50 micrometers, no more than about 25 micrometers, no more than about 10 micrometers, etc. In addition, in some cases, the maximum cross-sectional dimension may be at least about 5 micrometers, at least about 10 micrometers, at least about 25 micrometers, at least about 50 micrometers, at least about 75 micrometers, at least about 100 micrometers, at least about 200 micrometers, at least about 250 micrometers, at least about 300 micrometers, at least about 400 micrometers, at least about 500 micrometers, at least about 600 micrometers, at least about 800 micrometers, etc. In addition, in certain embodiments, combinations of these maximum cross-sectional dimensions are also possible. The maximal cross-sectional dimension of the second channel may also be the same or different from the maximal cross-sectional dimension of the first channel.

As mentioned, the first channel may be connected with the second channel with one or more side channels. A first fluid flowing from the first channel may pass through one or more of the side channels to enter a second fluid contained within the second channel. The first fluid may be substantially immiscible with the second fluid, and may thereby form droplets of first fluid contained within the second fluid. In some embodiments, as discussed, the side channels may be of substantially the same shape or size, and/or have a cross-sectional area that is substantially smaller than the cross-sectional area of the first or second channels, such that the resistance to fluid flow is largely dominated by the dimensions of the side channels; this may result in the creation of substantially monodisperse droplets in certain embodiments of the invention.

Accordingly, in one set of embodiments, the side channels may have an average resistance to fluid flow that is at least about 3 times greater than the resistance to fluid flow in the first and/or second channels. In addition, in certain cases, the average resistance to fluid flow in the side channels may be at least about 5 times greater, at least about 10 times greater, at least about 20 times greater, at least about 30 times greater, at least about 50 times greater, at least about 75 times greater, at least about 100 times greater, at least about 200 times greater, at least about 300 times greater, at least about 500 times greater, or at least about 1,000 times greater than the resistance to fluid flow of the first and/or second channels. In some cases, however, the average resistance to fluid flow in the side channels may be no more than about 1,000 times or 500 times greater than the resistance to fluid flow in the first and/or second channels. The side channels may also have average resistances that are substantially the same. In addition, in some cases, the side channels may have a resistance to fluid flow that varies between about 75% and about 125%, between about 80% and about 120%, between about 90% and about 110%, between about 95% and about 105%, between about 97% and about 103%, or between about 99% and about 101% of the average resistance to fluid flow of all of the side channels.

In one set of embodiments, a high resistance to fluid flow may be created using a side channel having a relatively small cross-sectional area or a relatively small minimum or maximum cross-sectional dimension within the side channel. In addition, in some embodiments, high resistances may be created using other techniques, such as coating the side channel and/or forming a relatively tortuous side channel, in addition or instead of controlling the cross-sectional area or cross-sectional dimension within the channel. Accordingly, the side channel may be substantially straight, e.g., as viewed visually, or the side channel may contain one or more curves, bends, or the like. If more than one side channel is present, the side channels may each have the same or different shapes. For example, some or all of the side channels may be substantially straight. In addition, a side channel may have any suitable cross-sectional shape, e.g., circular, oval, triangular, irregular, square or rectangular, or the like, and each side channel may independently have the same or different cross-sectional shapes. The cross-sectional shape of the side channels may also be the same or different than the cross-sectional shape of the first channel and/or the second channel.

A side channel may have any suitable maximal cross-sectional dimension, i.e., the largest dimension that can be contained within a cross-section of the side channel, where the cross-section is determined orthogonal to the direction of average fluid flow within the side channel. For example, the maximum cross-sectional dimension may be no more than 1 mm, no more than about 800 micrometers, no more than about 600 micrometers, no more than about 500 micrometers, no more than about 400 micrometers, no more than about 300 micrometers, no more than about 250 micrometers, no more than about 200 micrometers, no more than about 100 micrometers, no more than about 75 micrometers, no more than about 50 micrometers, no more than about 25 micrometers, no more than about 10 micrometers, etc. In addition, in some cases, the maximum cross-sectional dimension may be at least about 5 micrometers, at least about 10 micrometers, at least about 25 micrometers, at least about 50 micrometers, at least about 75 micrometers, at least about 100 micrometers, at least about 200 micrometers, at least about 250 micrometers, at least about 300 micrometers, at least about 400 micrometers, at least about 500 micrometers, at least about 600 micrometers, at least about 800 micrometers, etc. In addition, it should be noted that the height of a side channel need not be the same as the height of a first or second channel, e.g., as is shown in FIG. 1C.

In addition, in some embodiments, a side channels may have a ratio of the smallest cross-sectional dimension to the largest cross-sectional dimension within the channel of at least about 1:1.1, at least about 1:1.5, at least about 1:2, at least about 1:3, at least about 1:5, at least about 1:7, at least about 1:10, at least about 1:15, at least about 1:20, at least about 1:25, at least about 1:30, at least about 1:35, at least about 1:40, at least about 1:50, at least about 1:60, at least about 1:70, at least about 1:80, at least about 1:90, at least about 1:100, etc. In addition, in certain embodiments, the ratio may be no more than about 1:100, no more than about 1:90, no more than about 1:80, no more than about 1:70, no more than about 1:60, no more than about 1:50, no more than about 1:40, no more than about 1:35, no more than about 1:30, no more than about 1:25, no more than about 1:20, no more than about 1:15, no more than about 1:10, no more than about 1:7, no more than about 1:5, no more than about 1:3, no more than about 1:2, no more than about 1:1.5, etc. Combinations of any of these ratios are also possible in still other embodiments.

The side channel may also have any suitable length. In some cases, the length of the side channel may be determined by the distance of separation between the first channel and the second channel. In some cases, the side channels may have an average length of at least about 10 micrometers, at least about 20 micrometers, at least about 30 micrometers, at least about 50 micrometers, at least about 100 micrometers, at least about 200 micrometers, at least about 300 micrometers, at least about 500 micrometers, at least about 1,000 micrometers, at least about 2,000 micrometers, or the like. In certain embodiments, the side channels may have a length of no more than about 2,000 micrometers, no more than about 1,000 micrometers, no more than about 500 micrometers, no more than about 300 micrometers, no more than about 200 micrometers, no more than about 100 micrometers, no more than about 50 micrometers, no more than about 30 micrometers, no more than about 20 micrometers, or no more than about 10 micrometers. Combinations of any of these are also possible, e.g., the average length may be between about 300 micrometers and about 1,000 micrometers. In addition, in some embodiments, the lengths of the side channel may be substantially the same, or the lengths may vary between about 75% and about 125%, between about 80% and about 120%, between about 90% and about 110%, between about 95% and about 105%, between about 97% and about 103%, or between about 99% and about 101% of the average length of all of the side channels (or the distance of separation between the first and second channels).

In one set of embodiments, the average cross-sectional area of the side channels may be, at least about 20 micrometers$^2$, at least about 30 micrometers$^2$, at least about 50 micrometers$^2$, at least about 75 micrometers$^2$, at least about 100 micrometers$^2$, at least about 300 micrometers$^2$, at least about 400 micrometers$^2$, at least about 500 micrometers$^2$, at least about 750 micrometers$^2$, at least about 1,000 micrometers$^2$, at least about 1,600 micrometers$^2$, at least about 2,000 micrometers$^2$, at least about 3,000 micrometers$^2$, at least about 4,000 micrometers$^2$, at least about 5,000 micrometers$^2$, at least about 6,000 micrometers$^2$, at least about 6,400 micrometers$^2$, at least about 7,000 micrometers$^2$, at least about 8,000 micrometers$^2$, at least about 9,000 micrometers$^2$, at least about 10,000 micrometers$^2$, etc., and/or the average cross-sectional area of the side channels may be no more than about 10,000 micrometers$^2$, no more than about 9,000 micrometers$^2$, no more than about 8,000 micrometers$^2$, no more than about 7,000 micrometers$^2$, no more than about 6,400 micrometers$^2$, no more than about 6,000 micrometers$^2$, no more than about 6,000 micrometers$^2$, no more than about 5,000 micrometers$^2$, no more than about 4,000 micrometers$^2$, no more than about 3,000 micrometers$^2$, no more than about 2,000 micrometers$^2$, no more than about 1,600 micrometers$^2$, no more than about 1,000 micrometers$^2$, no more than about 750 micrometers$^2$, no more than about 500 micrometers$^2$, no more than about 400 micrometers$^2$, no more than about 300 micrometers$^2$, no more than about 100 micrometers$^2$, no more than about 75 micrometers$^2$, no more than about 50 micrometers$^2$, no more than about 30 micrometers$^2$, no more than about 20 micrometers$^2$, etc.

In some embodiments, the side channel may have a cross-sectional area that varies between about 75% and about 125%, between about 80% and about 120%, between about 90% and about 110%, between about 95% and about 105%, between about 97% and about 103%, or between about 99% and about 101% of the average cross-sectional area of all of the side channels. In addition, in some embodiments, the cross-sectional area of a side channel may be substantially constant, or may vary in some embodiments, e.g., as a function of position in the direction of fluid flow within the side channel. In some embodiments, the side channel may have a cross-sectional area that varies between about 75% and about 125%, between about 80% and about 120%, between about 90% and about 110%, between about 95% and about 105%, between about 97% and about 103%, or between about 99% and about 101% of the average cross-sectional area. In addition, in some embodiments, the volumes of the side channels may be substantially the same. In some cases, the side channels may have a volume that varies between about 75% and about 125%, between about 80% and about 120%, between about 90% and about 110%, between about 95% and about 105%, between about 97% and about 103%, or between about 99% and about 101% of the average volume of all of the side channels.

In one set of embodiments, the first channel and/or the second channel has a cross-sectional area at least about 10 times greater than the smallest cross-sectional area of the side channels, and in certain cases, at least about 15 times greater, at least about times greater, at least about 20 times greater, at least about 30 times greater, at least about 40 times greater, at least about 50 times greater, at least about 75 times greater, at least about 100 times greater, at least about 200 times greater, at least about 300 times greater, at least about 500 times greater, at least about 1,000 times greater, at least about 2,000 times greater, at least about 3,000 times greater, or at least about 5,000 times greater. However, in some cases, the cross-sectional area of the first channel and/or the second channel may be no more than about 5,000 times greater, no more than about 3,000 times greater, no more than about 2,000 times greater, no more than about 1,000 times greater, no more than about 500 times greater, no more than about 300 times greater, no more than about 200 times greater, no more than about 100 times greater, no more than about 75 times greater, no more than about 50 times greater, no more than about 40 times greater, no more than about 30 times greater, or no more than about 20 times greater than the smallest cross-sectional area of the side channels. Combinations of any of any of these ranges are also possible in other embodiments of the invention.

Any suitable number of side channels may be present. Larger numbers of side channels may be useful in producing droplets at greater rates, in accordance with some embodiments. In addition, if the resistance of the side channels to fluid flow is relatively large compared to the resistance of the first and/or second channels to fluid flow, then additional numbers of side channels may not substantially affect droplet production rates and/or the monodispersity of the droplets. Thus, in some embodiments, there may be relatively large numbers of side channels, e.g., connecting the first channel and the second channel. For instance, in one set of embodiments, there may be at least 5, at least 10, at least 15, at least 20, at least 25, at least 30, at least 50, at least 75, at least 100, at least 200, at least 300, at least 400, at least 500, at least 600, at least 800, at least 1,000, at least 1,200, at least 1,500, at least 2,000, at least 2,500, etc. side channels connecting the first channel and the second channel.

The side channels may intersect the first channel and/or the second channel at any suitable angle. In one set of embodiments, the angle of intersection between a side channel and a first channel and/or a second channel is about 90°. However, other angles are also possible. The side channels may each intersect the first channel and/or the second channel at substantially the same angle, or the intersection angles may each be independently the same or different. In addition, the angle of intersection with the first channel and with the second channel may also be the same or different, depending on the embodiment. In one set of embodiments, the side channels may each join the first channel and/or the second channel at an angle of between about 45° and about 135°, between about 70° and about 110°, between about 80° and about 100°, between about 85° and about 95°, between about 88° and about 92°, etc. In addition, the angle need not be near 90°. For example, a side channel may join the first channel and/or the second channel at an angle of about 10°, about 15°, about 20°, about 25°, about 30°, about 35°, about 40°, about 45°, about 50°, about 55°, about 60°, about 65°, about 70°, about 75°, about 80°, about 85°, about 90°, about 95°, about 100°, about 105°, about 110°, about 115°, about 120°, about 125°, about 130°, about 135°, about 140°, about 145°, about 150°, about 155°, about 160°, about 165°, about 170°, etc., and or angles between any of these values (e.g., between about 90° and about 170°, etc.).

In addition, the side channels may be arrayed between the first channel and the second channel in any suitable arrangement. In one set of embodiments, the side channels are linearly periodically spaced, e.g., such that the distances between any of the side channel and its nearest neighboring side channel is substantially the same, or at least such that the distance of separation between any neighboring side channels is between about 75% and about 125%, between about 80% and about 120%, between about 90% and about 110%, between about 95% and about 105%, between about 97% and about 103%, or between about 99% and about 101% of the average distance of separation between neighboring side channels. In some cases, e.g., if the cross-sectional area of the side channels is substantially constant, the spacing between the side channels may be used to determine the size of the droplets, e.g., as is shown in FIG. 1 and FIG. 9. In addition, in some cases, polydisperse droplets may be created, e.g., in devices that do not have substantially constant cross-sectional area of the side channels and/or substantially constant distances of separation between neighboring side channels.

In addition, in one set of embodiments, the side channels may be positioned relatively close to each other at the intersection of the side channels with the first and/or second channels. For example, in one embodiment, the side channels may be positioned such that the average distances between any of the side channel and its nearest neighboring side channel is substantially the same as the average cross-sectional area of the side channels. In another set of embodiments, the side channels are positioned to have a periodic spacing at the intersection of the side channels with the first and/or second channels that is between about 25% and about 400% of a smallest cross-sectional dimension of the side channels. In some cases, the periodic spacing is at least about 25%, at least about 50%, at least about 75%, at least about 100%, at least about 150%, or at least about 200% of the smallest cross-sectional dimension of the side channels, and/or the periodic spacing may be no more than about 200%, no more than about 100%, no more than about 75%, or no more than about 50% of the smallest cross-sectional dimension of the side channels.

In some cases, the side channels are positioned to intersect the first and/or second channels in a linear configuration, e.g., a 1×n configuration of intersections of the side channels with the first channel and/or second channel. In other embodiments, however, the side channels may intersect the first and/or second channels in a different or non-linear configuration; for example, the side channels may intersect in a 2-dimensional array of configuration of intersections, and the intersections may be regularly or irregularly spaced.

Figure 15A:
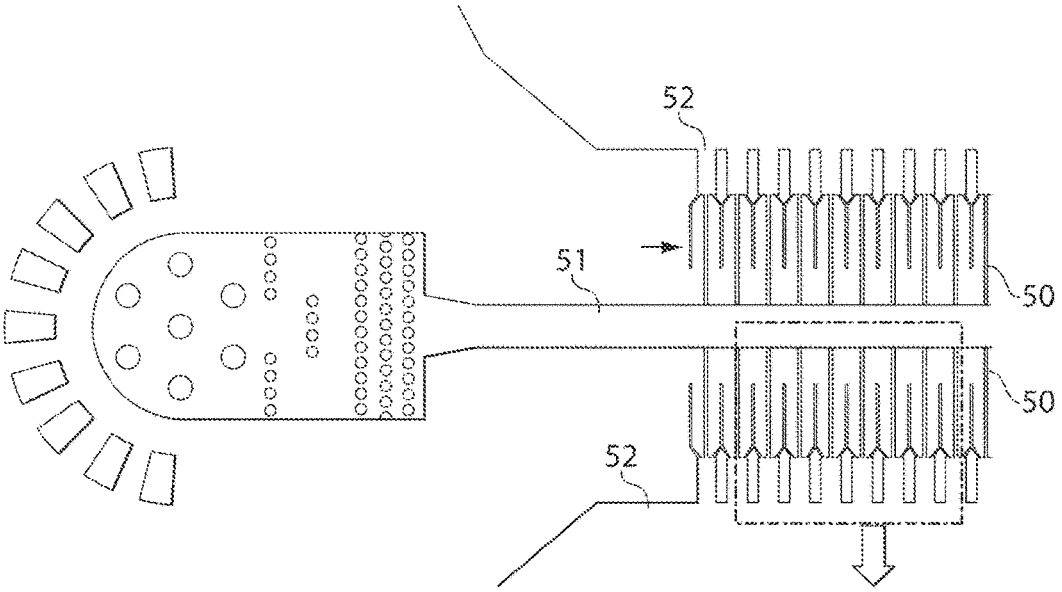
FIGS. 15A-15B illustrate an apparatus in still another embodiment of the invention.
Figure 15B:
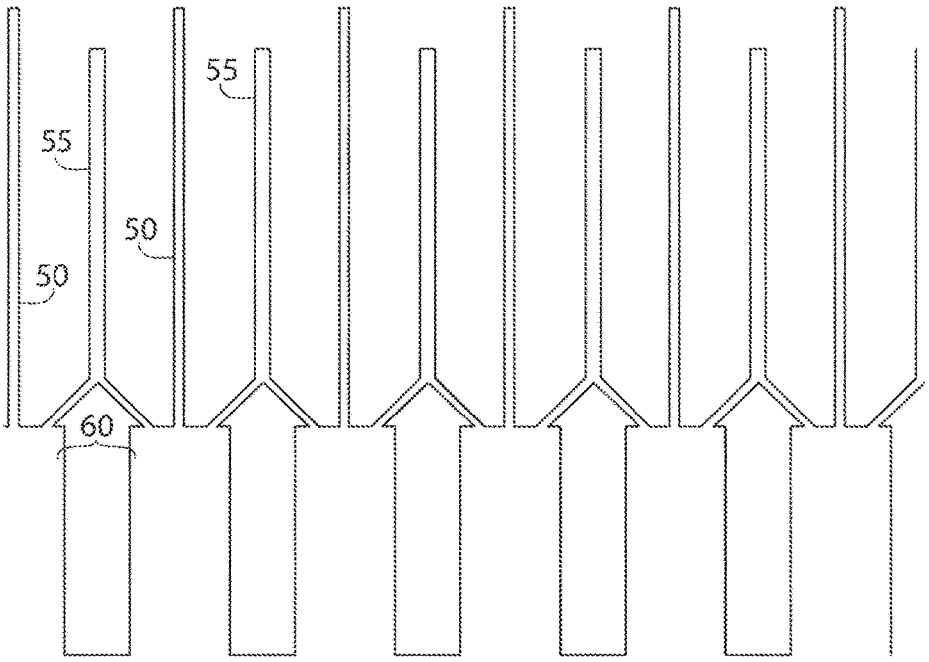

In addition, in some embodiments, the side channels may be in fluidic communication with other, auxiliary channels. These may be combined in certain embodiments with any of the systems or methods described herein, e.g., with multiple channels such as those described below. Thus, one or more auxiliary channels may be in fluid communication with a side channel, and in some cases, the auxiliary channels may be in fluidic communication with one or more side channels. As a non-limiting example, in FIG. 15B, a plurality of side channels 50 are shown connecting a first channel 51 and a second channel 52 as is shown in FIG. 15A. In fluidic communication with side channels 50 are auxiliary channels 55. In this example, auxiliary channels 55 contact two side channels, although this is by way of example only and in other embodiments, an auxiliary channel may be in fluid communication with only one side channel. A fluid may flow through auxiliary channels 55 to enter side channels 50 prior to fluids within side channel 50 entering second channel 52. In addition, in these figures, side channel 50 changes its cross-sectional area at region 60.

In one set of embodiments, such a configuration may be used to create a double emulsion droplet. For example, a first fluid in first channel 51 may flow through side channels 50 towards second channel 52. While flowing through first channel 51, a second fluid may flow through auxiliary channels 55 to at least partially surround the first fluid, e.g., at region 60. Second channel 52 may contain a third fluid such that the first fluid and the second fluid (surrounding the first fluid) may break off to form droplets, e.g., of the first fluid contained as droplets within the second fluid, which in turn are contained within a third fluid.

In another aspect, the second channel may be in fluidic communication with a third channel or more than one third channel, in some cases, for example, via a plurality of side channels connecting the second channel with the third channel, in a manner similar to any of those described above with respect to side channels connecting the first channel with the second channel. The second channel may similarly have dimensions, shapes, sizes, coating, etc., similar to those described above with respect to the first channel. The side channels connecting the second channel with the third channel may independently be the same or different as the side channels connecting the first channel with the second channel, e.g., having the same or different numbers, dimensions, sizes, areas, coatings, geometries, cross-sectional areas, maximum cross-sectional dimensions, etc.

Figure 14A:
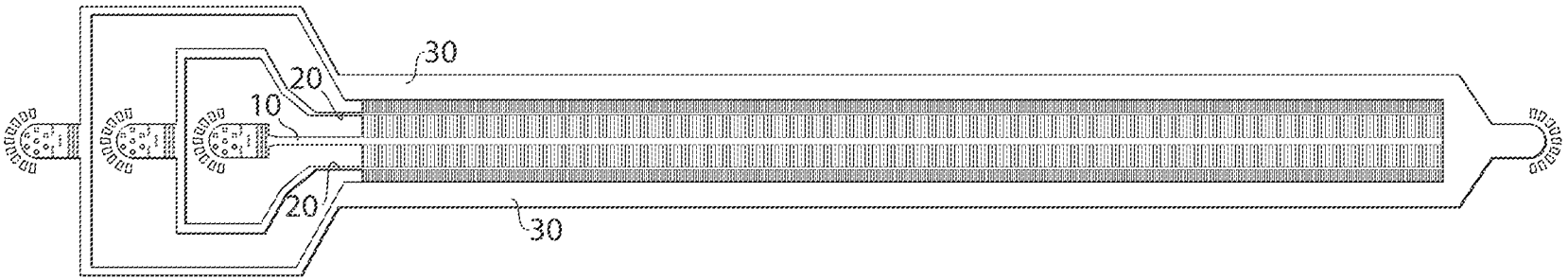
FIGS. 14A-14B illustrate various apparatuses, in accordance with additional embodiments of the invention.
Figure 14B:
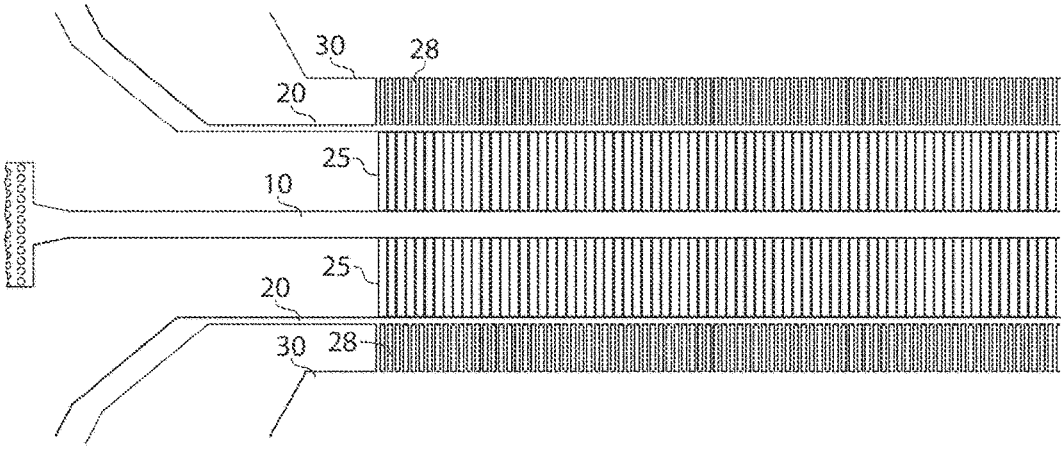

In one set of embodiments, such a configuration may be used to create a double emulsion droplet (e.g., where a first fluid is contained as a droplet within of a second fluid, that in turn is contained as a droplet within a third fluid). In some embodiments, higher-order multiple emulsion droplets may also be created. Typically, the first fluid is substantially immiscible with the second fluid and the second fluid is substantially immiscible with the third fluid (the first fluid and the third fluid may be miscible or immiscible with each other, depending on the embodiment). Thus, for example, a first fluid may flow from the first channel through a plurality of side channels into a second fluid contained within a second channel. The second fluid (containing droplets of the first fluid) may in turn flow through a plurality of side channels from the second channel into a third channel containing a third fluid. One non-limiting example of such a configuration is shown in FIGS. 14A and 14B, which is an expanded view of FIG. 14A. In these figures fluid entering through first channel 10 flows through a plurality of side channels 25 to second channel 20; droplets of first fluid contained within a continuous second fluid then flow through side channels 28 to third channel 30. In these figures, this pattern of channels is also repeated on either side of the first channel, although this is not necessarily a requirement.

In addition, this "nesting" pattern may be repeated one or more times, e.g., to create higher-order droplets. For example, the third fluid could be flowed through a plurality of side channels to a fourth fluid containing a fourth fluid (which may be substantially immiscible with the third fluid), and this process may be repeated, etc., to create triple, quadruple, or higher-order multiple emulsions (e.g., a droplet within a droplet within a droplet, etc.). The side channels used to connect the other channels may independently by the same or different. In addition, as previously discussed, a multiple emulsion droplet (e.g., a triple or higher-order emulsion droplet) may be created by using an emulsion (including a multiple emulsion) as a first fluid within any of the devices discussed herein.

As mentioned, certain aspects of the invention are directed to the production of droplets using apparatuses and devices such as those described herein. In some cases, e.g., with relatively large numbers of side channels, relatively large droplet production rates may be achieved. For instance, in some cases, greater than about 1,000 droplets/s, greater than or equal to 5,000 droplets/s, greater than about 10,000 droplets/s, greater than about 50,000 droplets/s, greater than about 100,000 droplets/s, greater than about 300,000 droplets/s, greater than about 500,000 droplets/s, or greater than about 1,000,000 droplets/s, etc. may be produced.

In addition, in some cases, a plurality of droplets may be produced that are substantially monodisperse, in some embodiments. In some cases, the plurality of droplets may have a distribution of characteristic dimensions such that no more than about 20%, no more than about 18%, no more than about 16%, no more than about 15%, no more than about 14%, no more than about 13%, no more than about 12%, no more than about 11%, no more than about 10%, no more than about 5%, no more than about 4%, no more than about 3%, no more than about 2%, no more than about 1%, or less, of the droplets have a characteristic dimension greater than or less than about 20%, less than about 30%, less than about 50%, less than about 75%, less than about 80%, less than about 90%, less than about 95%, less than about 99%, or more, of the average characteristic dimension of all of the droplets. Those of ordinary skill in the art will be able to determine the average characteristic dimension of a population of droplets, for example, using laser light scattering, microscopic examination, or other known techniques. In one set of embodiments, the plurality of droplets may have a distribution of characteristic dimension such that no more than about 20%, no more than about 10%, or no more than about 5% of the droplets may have a characteristic dimension greater than about 120% or less than about 80%, greater than about 115% or less than about 85%, greater than about 110% or less than about 90%, greater than about 105% or less than about 95%, greater than about 103% or less than about 97%, or greater than about 101% or less than about 99% of the average of the characteristic dimension of the plurality of droplets. The "characteristic dimension" of a droplet, as used herein, is the diameter of a perfect sphere having the same volume as the droplet. In addition, in some instances, the coefficient of variation of the characteristic dimension of the exiting droplets may be less than or equal to about 20%, less than or equal to about 15%, less than or equal to about 10%, less than or equal to about 5%, less than or equal to about 3%, or less than or equal to about 1%.

The average characteristic dimension of the plurality of droplets, in some embodiments, may be less than about 1 mm, less than about 500 micrometers, less than about 200 micrometers, less than about 100 micrometers, less than about 75 micrometers, less than about 50 micrometers, less than about 25 micrometers, less than about 10 micrometers, or less than about 5 micrometers in some cases. The average characteristic dimension may also be greater than or equal to about 1 micrometer, greater than or equal to about 2 micrometers, greater than or equal to about 3 micrometers, greater than or equal to about 5 micrometers, greater than or equal to about 10 micrometers, greater than or equal to about 15 micrometers, or greater than or equal to about 20 micrometers in certain cases.

In some embodiments, a droplet may undergo additional processes. In one example, a droplet may be converted into a particle (e.g., by a polymerization process). In another example, a droplet may be sorted and/or detected. For example, a species within a droplet may be determined, and the droplet may be sorted based on that determination. In general, a droplet may undergo any suitable process known to those of ordinary skill in the art. See, e.g., Int. Pat. Apl. No. PCT/US2004/010903, filed Apr. 9, 2004, entitled "Formation and Control of Fluidic Species," by Link, et al., published as WO 2004/091763 on Oct. 28, 2004; Int. Pat. Apl. No. PCT/US2003/020542, filed Jun. 30, 2003, entitled "Method and Apparatus for Fluid Dispersion," by Stone, et al., published as WO 2004/002627 on Jan. 8, 2004; Int. Pat. Apl. No. PCT/US2006/007772, filed Mar. 3, 2006, entitled "Method and Apparatus for Forming Multiple Emulsions," by Weitz, et al., published as WO 2006/096571 on Sep. 14, 2006; Int. Pat. Apl. No. PCT/US2004/027912, filed Aug. 27, 2004, entitled "Electronic Control of Fluidic Species," by Link, et al., published as WO 2005/021151 on Mar. 10, 2005, each of which is incorporated herein by reference in their entireties.

Thus, in some embodiments, at least a portion of the droplet may be hardened or solidified, e.g., to form a particle. Such hardening or solidification may occur using any suitable technique, e.g., a chemical reaction, a phase change, a temperature change, or the like. For example, at least a portion of a droplet may be solidified using a chemical reaction that causes solidification to occur of the droplet to occur, e.g., to form a particle. For example, two or more reactants added to a fluidic droplet may react to produce a solid product, e.g., as a shell material. As another example, a first reactant contained within a fluidic droplet may be reacted with a second reactant the droplet to produce a solid. In addition, in one embodiment, a monomer or oligomer solution can be polymerized by decomposing initiators, e.g. with UV light or a change in temperature.

In one set of embodiments, a material may be formed by a polymerization reaction. Polymerization can be accomplished in a number of ways, including using a pre-polymer or a monomer that can be catalyzed, for example, chemically, through heat, via electromagnetic radiation (e.g., ultraviolet radiation), etc. to form a solid particle. For instance, one or more monomer or oligomer precursors (e.g., dissolved and/or suspended within a fluidic droplet) may be polymerized to form a polymer. The polymerization reaction may occur spontaneously, or be initiated in some fashion, e.g., during formation of a fluidic droplet, or after the fluidic droplet has been formed. For instance, the polymerization reaction may be initiated by adding an initiator to the fluidic droplet, by applying light or other electromagnetic energy to the fluidic droplet (e.g., to initiate a photopolymerization reaction), or the like, causing polymerization and formation to occur. In some embodiments, redox initiation may be used. For example, certain monomers containing hydroxyl groups may undergo redox reactions with ceric ions or other oxidizing agents to form radicals capable of initiating a polymerization reaction. Additional non-limiting examples include peroxide initiators reacting with ascorbic acid or other suitable acids.

In some embodiments, a species may be contained within the droplet, e.g., before or after formation. Thus, for example, a species may be contained within the first fluid and/or the second fluid. In some cases, more than one species may be present. Thus, for example, a precise quantity of a drug, pharmaceutical, or other agent can be contained within a droplet. As another example, one or more cells may be contained within a droplet. Other species that can be contained within a droplet include, for example, biochemical species such as nucleic acids such as siRNA, mRNA, RNAi and DNA, proteins, peptides, or enzymes, or the like. Additional species that can be contained within a droplet include, but are not limited to, nanoparticles, quantum dots, fragrances, proteins, indicators, dyes, fluorescent species, chemicals, amphiphilic compounds, detergents, drugs, foods or food components, or the like. Further examples of species that can be contained within a droplet include, but are not limited to, pesticides, such as herbicides, fungicides, insecticides, growth regulators, vitamins, hormones, and microbicides. A droplet can also serve as a reaction vessel in certain cases, such as for controlling chemical reactions, or for in vitro transcription and translation, e.g., for directed evolution technology.

Certain aspects of the invention are generally directed to devices containing channels such as those described above. In some cases, some of the channels may be microfluidic channels, but in certain instances, not all of the channels are microfluidic. There can be any number of channels, including microfluidic channels, within the device, and the channels may be arranged in any suitable configuration. The channels may be all interconnected, or there can be more than one network of channels present. The channels may independently be straight, curved, bent, etc. In some cases, there may be a relatively large number and/or a relatively large length of channels present in the device. For example, in some embodiments, the channels within a device, when added together, can have a total length of at least about 100 micrometers, at least about 300 micrometers, at least about 500 micrometers, at least about 1 mm, at least about 3 mm, at least about 5 mm, at least about 10 mm, at least about 30 mm, at least 50 mm, at least about 100 mm, at least about 300 mm, at least about 500 mm, at least about 1 m, at least about 2 m, or at least about 3 m in some cases. As another example, a device can have at least 1 channel, at least 3 channels, at least 5 channels, at least 10 channels, at least 20 channels, at least 30 channels, at least 40 channels, at least 50 channels, at least 70 channels, at least 100 channels, etc.

In some embodiments, at least some of the channels within the device are microfluidic channels. "Microfluidic," as used herein, refers to a device, article, or system including at least one fluid channel having a cross-sectional dimension of less than about 1 mm. The "cross-sectional dimension" of the channel is measured perpendicular to the direction of net fluid flow within the channel. Thus, for example, some or all of the fluid channels in a device can have a maximum cross-sectional dimension less than about 2 mm, and in certain cases, less than about 1 mm. In one set of embodiments, all fluid channels in a device are microfluidic and/or have a largest cross sectional dimension of no more than about 2 mm or about 1 mm. In certain embodiments, the fluid channels may be formed in part by a single component (e.g. an etched substrate or molded unit). Of course, larger channels, tubes, chambers, reservoirs, etc. can be used to store fluids and/or deliver fluids to various elements or systems in other embodiments of the invention, for example, as previously discussed. In one set of embodiments, the maximum cross-sectional dimension of the channels in a device is less than 500 micrometers, less than 200 micrometers, less than 100 micrometers, less than 50 micrometers, or less than 25 micrometers.

A "channel," as used herein, means a feature on or in a device or substrate that at least partially directs flow of a fluid. The channel can have any cross-sectional shape (circular, oval, triangular, irregular, square or rectangular, or the like) and can be covered or uncovered. In embodiments where it is completely covered, at least one portion of the channel can have a cross-section that is completely enclosed, or the entire channel may be completely enclosed along its entire length with the exception of its inlets and/or outlets or openings. A channel may also have an aspect ratio (length to average cross sectional dimension) of at least 2:1, more typically at least about 3:1, at least about 4:1, at least about 5:1, at least about 6:1, at least about 8:1, at least about 10:1, at least about 15:1, at least about 20:1, at least about 30:1, at least about 40:1, at least about 50:1, at least about 60:1, at least about 70:1, at least about 80:1, at least about 90:1, at least about 100:1 or more. An open channel generally will include characteristics that facilitate control over fluid transport, e.g., structural characteristics (an elongated indentation) and/or physical or chemical characteristics (hydrophobicity vs. hydrophilicity) or other characteristics that can exert a force (e.g., a containing force) on a fluid. Non-limiting examples of force actuators that can produce suitable forces include piezo actuators, pressure valves, electrodes to apply AC electric fields, and the like. The fluid within the channel may partially or completely fill the channel. In some cases where an open channel is used, the fluid may be held within the channel, for example, using surface tension (i.e., a concave or convex meniscus).

The channel may be of any size, for example, having a largest dimension perpendicular to net fluid flow of less than about 5 mm or 2 mm, or less than about 1 mm, less than about 500 microns, less than about 200 microns, less than about 100 microns, less than about 60 microns, less than about 50 microns, less than about 40 microns, less than about 30 microns, less than about 25 microns, less than about 10 microns, less than about 3 microns, less than about 1 micron, less than about 300 nm, less than about 100 nm, less than about 30 nm, or less than about 10 nm. In some cases, the dimensions of the channel are chosen such that fluid is able to freely flow through the device or substrate. The dimensions of the channel may also be chosen, for example, to allow a certain volumetric or linear flow rate of fluid in the channel. Of course, the number of channels and the shape of the channels can be varied by any method known to those of ordinary skill in the art. In some cases, more than one channel may be used. For example, two or more channels may be used, where they are positioned adjacent or proximate to each other, positioned to intersect with each other, etc.

In certain embodiments, one or more of the channels within the device may have an average cross-sectional dimension of less than about 10 cm. In certain instances, the average cross-sectional dimension of the channel is less than about 5 cm, less than about 3 cm, less than about 1 cm, less than about 5 mm, less than about 3 mm, less than about 1 mm, less than 500 micrometers, less than 200 micrometers, less than 100 micrometers, less than 50 micrometers, or less than 25 micrometers. The "average cross-sectional dimension" is measured in a plane perpendicular to net fluid flow within the channel. If the channel is non-circular, the average cross-sectional dimension may be taken as the diameter of a circle having the same area as the cross-sectional area of the channel. Thus, the channel may have any suitable cross-sectional shape, for example, circular, oval, triangular, irregular, square, rectangular, quadrilateral, or the like. In some embodiments, the channels are sized so as to allow laminar flow of one or more fluids contained within the channel to occur.

The channel may also have any suitable cross-sectional aspect ratio. The "cross-sectional aspect ratio" is, for the cross-sectional shape of a channel, the largest possible ratio (large to small) of two measurements made orthogonal to each other on the cross-sectional shape. For example, the channel may have a cross-sectional aspect ratio of less than about 2:1, less than about 1.5:1, or in some cases about 1:1 (e.g., for a circular or a square cross-sectional shape). In other embodiments, the cross-sectional aspect ratio may be relatively large. For example, the cross-sectional aspect ratio may be at least about 2:1, at least about 3:1, at least about 4:1, at least about 5:1, at least about 6:1, at least about 7:1, at least about 8:1, at least about 10:1, at least about 12:1, at least about 15:1, or at least about 20:1.

As mentioned, the channels can be arranged in any suitable configuration within the device. Different channel arrangements may be used, for example, to manipulate fluids, droplets, and/or other species within the channels. For example, channels within the device can be arranged to create droplets (e.g., discrete droplets, single emulsions, double emulsions or other multiple emulsions, etc.), to mix fluids and/or droplets or other species contained therein, to screen or sort fluids and/or droplets or other species contained therein, to split or divide fluids and/or droplets, to cause a reaction to occur (e.g., between two fluids, between a species carried by a first fluid and a second fluid, or between two species carried by two fluids to occur), or the like.

Non-limiting examples of systems for manipulating fluids, droplets, and/or other species are discussed below. Additional examples of suitable manipulation systems can also be seen in U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. patent application Ser. No. 11/024,228, filed Dec. 28, 2004, entitled "Method and Apparatus for Fluid Dispersion," by Stone, et al., now U.S. Pat. No. 7,708,949, issued May 4, 2010; U.S. patent application Ser. No. 11/885,306, filed Aug. 29, 2007, entitled "Method and Apparatus for Forming Multiple Emulsions," by Weitz, et al., published as U.S. Patent Application Publication No. 2009/0131543 on May 21, 2009; and U.S. patent application Ser. No. 11/360,845, filed Feb. 23, 2006, entitled "Electronic Control of Fluidic Species," by Link, et al., published as U.S. Patent Application Publication No. 2007/0003442 on Jan. 4, 2007; each of which is incorporated herein by reference in its entirety.

Fluids may be delivered into channels within a device via one or more fluid sources. Any suitable source of fluid can be used, and in some cases, more than one source of fluid is used. For example, a pump, gravity, capillary action, surface tension, electroosmosis, centrifugal forces, etc. may be used to deliver a fluid from a fluid source into one or more channels in the device. A vacuum (e.g., from a vacuum pump or other suitable vacuum source) can also be used in some embodiments. Non-limiting examples of pumps include syringe pumps, peristaltic pumps, pressurized fluid sources, or the like. The device can have any number of fluid sources associated with it, for example, 1, 2, 3, 4, 5, 6, 7, 8, 9, 10, etc., or more fluid sources. The fluid sources need not be used to deliver fluid into the same channel, e.g., a first fluid source can deliver a first fluid to a first channel while a second fluid source can deliver a second fluid to a second channel, etc. In some cases, two or more channels are arranged to intersect at one or more intersections. There may be any number of fluidic channel intersections within the device, for example, 2, 3, 4, 5, 6, etc., or more intersections.

A variety of materials and methods, according to certain aspects of the invention, can be used to form devices or components such as those described herein, e.g., channels such as microfluidic channels, chambers, etc. For example, various devices or components can be formed from solid materials, in which the channels can be formed via micromachining, film deposition processes such as spin coating and chemical vapor deposition, physical vapor deposition, laser fabrication, photolithographic techniques, etching methods including wet chemical or plasma processes, electrodeposition, and the like. See, for example, *Scientific American,* 248:44-55, 1983 (Angell, et al).

In one set of embodiments, various structures or components of the devices described herein can be formed of a polymer, for example, an elastomeric polymer such as polydimethylsiloxane ("PDMS"), polytetrafluoroethylene ("PTFE" or Teflon®), or the like. For instance, according to one embodiment, a channel such as a microfluidic channel may be implemented by fabricating the fluidic system separately using PDMS or other soft lithography techniques (details of soft lithography techniques suitable for this embodiment are discussed in the references entitled "Soft Lithography," by Younan Xia and George M. Whitesides, published in the *Annual Review of Material Science,* 1998, Vol. 28, pages 153-184, and "Soft Lithography in Biology and Biochemistry," by George M. Whitesides, Emanuele Ostuni, Shuichi Takayama, Xingyu Jiang and Donald E. Ingber, published in the *Annual Review of Biomedical Engineering,* 2001, Vol. 3, pages 335-373; each of these references is incorporated herein by reference).

Other examples of potentially suitable polymers include, but are not limited to, polyethylene terephthalate (PET), polyacrylate, polymethacrylate, polycarbonate, polystyrene, polyethylene, polypropylene, polyvinylchloride, cyclic olefin copolymer (COC), polytetrafluoroethylene, a fluorinated polymer, a silicone such as polydimethylsiloxane, polyvinylidene chloride, bis-benzocyclobutene ("BCB"), a polyimide, a fluorinated derivative of a polyimide, or the like. Combinations, copolymers, or blends involving polymers including those described above are also envisioned. The device may also be formed from composite materials, for example, a composite of a polymer and a semiconductor material.

In some embodiments, various structures or components of the device are fabricated from polymeric and/or flexible and/or elastomeric materials, and can be conveniently formed of a hardenable fluid, facilitating fabrication via molding (e.g. replica molding, injection molding, cast molding, etc.). The hardenable fluid can be essentially any fluid that can be induced to solidify, or that spontaneously solidifies, into a solid capable of containing and/or transporting fluids contemplated for use in and with the fluidic network. In one embodiment, the hardenable fluid comprises a polymeric liquid or a liquid polymeric precursor (i.e. a "prepolymer"). Suitable polymeric liquids can include, for example, thermoplastic polymers, thermoset polymers, waxes, metals, or mixtures or composites thereof heated above their melting point. As another example, a suitable polymeric liquid may include a solution of one or more polymers in a suitable solvent, which solution forms a solid polymeric material upon removal of the solvent, for example, by evaporation. Such polymeric materials, which can be solidified from, for example, a melt state or by solvent evaporation, are well known to those of ordinary skill in the art. A variety of polymeric materials, many of which are elastomeric, are suitable, and are also suitable for forming molds or mold masters, for embodiments where one or both of the mold masters is composed of an elastomeric material. A non-limiting list of examples of such polymers includes polymers of the general classes of silicone polymers, epoxy polymers, and acrylate polymers. Epoxy polymers are characterized by the presence of a three-membered cyclic ether group commonly referred to as an epoxy group, 1,2-epoxide, or oxirane. For example, diglycidyl ethers of bisphenol A can be used, in addition to compounds based on aromatic amine, triazine, and cycloaliphatic backbones. Another example includes the well-known Novolac polymers. Non-limiting examples of silicone elastomers suitable for use according to the invention include those formed from precursors including the chlorosilanes such as methylchlorosilanes, ethylchlorosilanes, phenylchlorosilanes, etc.

Silicone polymers are used in certain embodiments, for example, the silicone elastomer polydimethylsiloxane. Non-limiting examples of PDMS polymers include those sold under the trademark Sylgard by Dow Chemical Co., Midland, Mich., and particularly Sylgard 182, Sylgard 184, and Sylgard 186. Silicone polymers including PDMS have several beneficial properties simplifying fabrication of various structures of the invention. For instance, such materials are inexpensive, readily available, and can be solidified from a prepolymeric liquid via curing with heat. For example, PDMSs are typically curable by exposure of the prepolymeric liquid to temperatures of about, for example, about 65° C. to about 75° C. for exposure times of, for example, at least about an hour. Also, silicone polymers, such as PDMS, can be elastomeric and thus may be useful for forming very small features with relatively high aspect ratios, necessary in certain embodiments of the invention. Flexible (e.g., elastomeric) molds or masters can be advantageous in this regard.

One advantage of forming structures such as microfluidic structures or channels from silicone polymers, such as PDMS, is the ability of such polymers to be oxidized, for example by exposure to an oxygen-containing plasma such as an air plasma, so that the oxidized structures contain, at their surface, chemical groups capable of cross-linking to other oxidized silicone polymer surfaces or to the oxidized surfaces of a variety of other polymeric and non-polymeric materials. Thus, structures can be fabricated and then oxidized and essentially irreversibly sealed to other silicone polymer surfaces, or to the surfaces of other substrates reactive with the oxidized silicone polymer surfaces, without the need for separate adhesives or other sealing means. In most cases, sealing can be completed simply by contacting an oxidized silicone surface to another surface without the need to apply auxiliary pressure to form the seal. That is, the pre-oxidized silicone surface acts as a contact adhesive against suitable mating surfaces. Specifically, in addition to being irreversibly sealable to itself, oxidized silicone such as oxidized PDMS can also be sealed irreversibly to a range of oxidized materials other than itself including, for example, glass, silicon, silicon oxide, quartz, silicon nitride, polyethylene, polystyrene, glassy carbon, and epoxy polymers, which have been oxidized in a similar fashion to the PDMS surface (for example, via exposure to an oxygen-containing plasma). Oxidation and sealing methods useful in the context of the present invention, as well as overall molding techniques, are described in the art, for example, in an article entitled "Rapid Prototyping of Microfluidic Systems and Polydimethylsiloxane," *Anal. Chem.,* 70:474-480, 1998 (Duffy et al.), incorporated herein by reference.

Another advantage to forming channels or other structures (or interior, fluid-contacting surfaces) from oxidized silicone polymers is that these surfaces can be much more hydrophilic than the surfaces of typical elastomeric polymers (where a hydrophilic interior surface is desired). Such hydrophilic channel surfaces can thus be more easily filled and wetted with aqueous solutions than can structures comprised of typical, unoxidized elastomeric polymers or other hydrophobic materials.

In some aspects, such devices may be produced using more than one layer or substrate, e.g., more than one layer of PDMS. For instance, devices having channels with multiple heights and/or devices having interfaces positioned such as described herein may be produced using more than one layer or substrate, which may then be assembled or bonded together, e.g., e.g., using plasma bonding, to produce the final device. As a specific example, a device as discussed herein may be molded from masters comprising two or more layers of photoresists, e.g., where two PDMS molds are then bonded together by activating the PDMS surfaces using $O_2$ plasma or other suitable techniques. For example, in some cases, the masters from which the PDMS device is cast may contain one or multiple layers of photoresist, e.g., to form a 3D device. In some embodiments, one or more of the layers may have one or more mating protrusions and/or indentations which are aligned to properly align the layers, e.g., in a lock-and-key fashion. For example, a first layer may have a protrusion (having any suitable shape) and a second layer may have a corresponding indentation which can receive the protrusion, thereby causing the two layers to become properly aligned with respect to each other.

In some aspects, one or more walls or portions of a channel may be coated, e.g., with a coating material, including photoactive coating materials. For example, in some embodiments, each of the microfluidic channels at the common junction may have substantially the same hydrophobicity, although in other embodiments, various channels may have different hydrophobicities. For example a first channel (or set of channels) at a common junction may exhibit a first hydrophobicity, while the other channels may exhibit a second hydrophobicity different from the first hydrophobicity, e.g., exhibiting a hydrophobicity that is greater or less than the first hydrophobicity. Non-limiting examples of systems and methods for coating microfluidic channels, for example, with sol-gel coatings, may be seen in International Patent Application No. PCT/US2009/000850, filed Feb. 11, 2009, entitled "Surfaces, Including Microfluidic Channels, With Controlled Wetting Properties," by Abate, et al., published as WO 2009/120254 on Oct. 1, 2009, and International Patent Application No. PCT/US2008/009477, filed Aug. 7, 2008, entitled "Metal Oxide Coating on Surfaces," by Weitz, et al., published as WO 2009/020633 on Feb. 12, 2009, each incorporated herein by reference in its entirety. Other examples of coatings include polymers, metals, or ceramic coatings, e.g., using techniques known to those of ordinary skill in the art.

As mentioned, in some cases, some or all of the channels may be coated, or otherwise treated such that some or all of the channels, including the inlet and daughter channels, each have substantially the same hydrophilicity. The coating materials can be used in certain instances to control and/or alter the hydrophobicity of the wall of a channel. In some embodiments, a sol-gel is provided that can be formed as a coating on a substrate such as the wall of a channel such as a microfluidic channel. One or more portions of the sol-gel can be reacted to alter its hydrophobicity, in some cases. For example, a portion of the sol-gel may be exposed to light, such as ultraviolet light, which can be used to induce a chemical reaction in the sol-gel that alters its hydrophobicity. The sol-gel may include a photoinitiator which, upon exposure to light, produces radicals. Optionally, the photoinitiator is conjugated to a silane or other material within the sol-gel. The radicals so produced may be used to cause a condensation or polymerization reaction to occur on the surface of the sol-gel, thus altering the hydrophobicity of the surface. In some cases, various portions may be reacted or left unreacted, e.g., by controlling exposure to light (for instance, using a mask).

A variety of definitions are now provided which will aid in understanding various aspects of the invention. Following, and interspersed with these definitions, is further disclosure that will more fully describe the invention.

A "droplet," as used herein, is an isolated portion of a first fluid that is completely surrounded by a second fluid. In some cases, the first fluid and the second fluid are substantially immiscible. It is to be noted that a droplet is not necessarily spherical, but may assume other shapes as well, for example, depending on the external environment. The diameter of a droplet, in a non-spherical droplet, is the diameter of a perfect mathematical sphere having the same volume as the non-spherical droplet. The droplets may be created using any suitable technique, as previously discussed.

As used herein, a "fluid" is given its ordinary meaning, i.e., a liquid or a gas. A fluid cannot maintain a defined shape and will flow during an observable time frame to fill the container in which it is put. Thus, the fluid may have any suitable viscosity that permits flow. If two or more fluids are present, each fluid may be independently selected among essentially any fluids (liquids, gases, and the like) by those of ordinary skill in the art.

Certain embodiments of the present invention provide a plurality of droplets. In some embodiments, the plurality of droplets is formed from a first fluid, and may be substantially surrounded by a second fluid. As used herein, a droplet is "surrounded" by a fluid if a closed loop can be drawn around the droplet through only the fluid. A droplet is "completely surrounded" if closed loops going through only the fluid can be drawn around the droplet regardless of direction. A droplet is "substantially surrounded" if the loops going through only the fluid can be drawn around the droplet depending on the direction (e.g., in some cases, a loop around the droplet will comprise mostly of the fluid by may also comprise a second fluid, or a second droplet, etc.).

In most, but not all embodiments, the droplets and the fluid containing the droplets are substantially immiscible. In some cases, however, they may be miscible. In some cases, a hydrophilic liquid may be suspended in a hydrophobic liquid, a hydrophobic liquid may be suspended in a hydrophilic liquid, a gas bubble may be suspended in a liquid, etc. Typically, a hydrophobic liquid and a hydrophilic liquid are substantially immiscible with respect to each other, where the hydrophilic liquid has a greater affinity to water than does the hydrophobic liquid. Examples of hydrophilic liquids include, but are not limited to, water and other aqueous solutions comprising water, such as cell or biological media, ethanol, salt solutions, etc. Examples of hydrophobic liquids include, but are not limited to, oils such as hydrocarbons, silicon oils, fluorocarbon oils, organic solvents etc. In some cases, two fluids can be selected to be substantially immiscible within the time frame of formation of a stream of fluids. Those of ordinary skill in the art can select suitable substantially miscible or substantially immiscible fluids, using contact angle measurements or the like, to carry out the techniques of the invention.

The following documents are incorporated herein by reference in their entireties: International Patent Application No. PCT/US04/10903, filed Apr. 9, 2004, entitled "Formation and Control of Fluidic Species," by Link, et al., published as WO 2004/091763 on Oct. 28, 2004; International Patent Application No. PCT/US03/20542, filed Jun. 30, 2003, entitled "Method and Apparatus for Fluid Dispersion," by Stone, et al., published as WO 2004/002627 on Jan. 8, 2004; International Patent Application No. PCT/US04/27912, filed Aug. 27, 2004, entitled "Electronic Control of Fluidic Species," by Link, et al., published as WO 2005/021151 on Mar. 10, 2005; and U.S. Pat. No. 8,337,778. In addition, U.S. Provisional Patent Application Ser. No. 61/823,175, filed May 14, 2013, entitled "Rapid Production of Droplets," is incorporated herein by reference in its entirety.

The following examples are intended to illustrate certain embodiments of the present invention, but do not exemplify the full scope of the invention.

EXAMPLE 1

These examples describe microfluidic devices that allow the production of relatively monodisperse droplets with average diameters ranging from 30 to 200 micrometers at a high throughput rate. All the devices used in the following examples were 3D poly(dimethyl siloxane) (PDMS) based microfluidic devices each having one 175 micrometer wide, 210 micrometer tall, and 3 mm long reservoir that was connected to the inlet of the disperse phase. Each reservoir was surrounded by 210 micrometer tall main channels through which the continuous phase flows. The device can be divided into two parts that are mirror images of each other; the mirror plane goes along the center of the long axis of the reservoir.

Figure 1B:
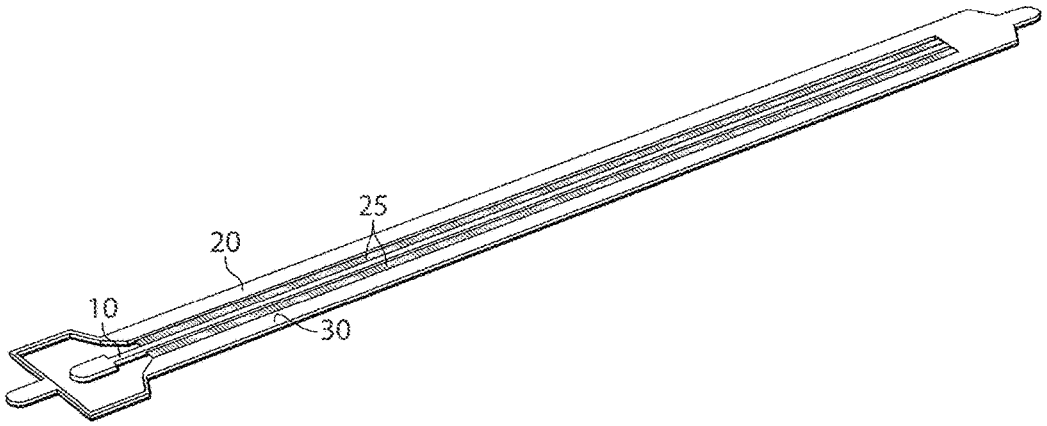
Figure 1C:
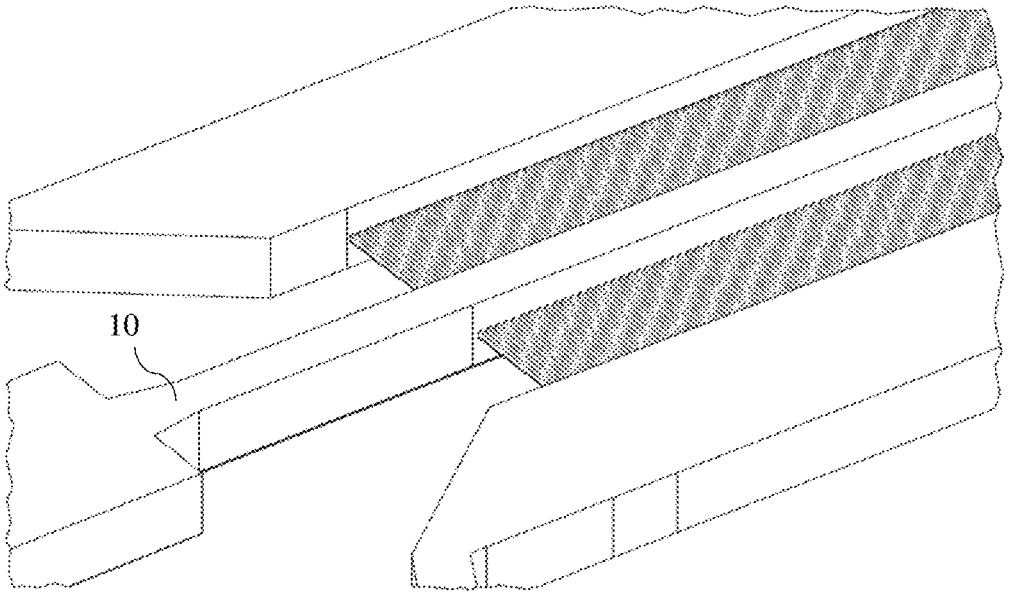
Figure 2A:
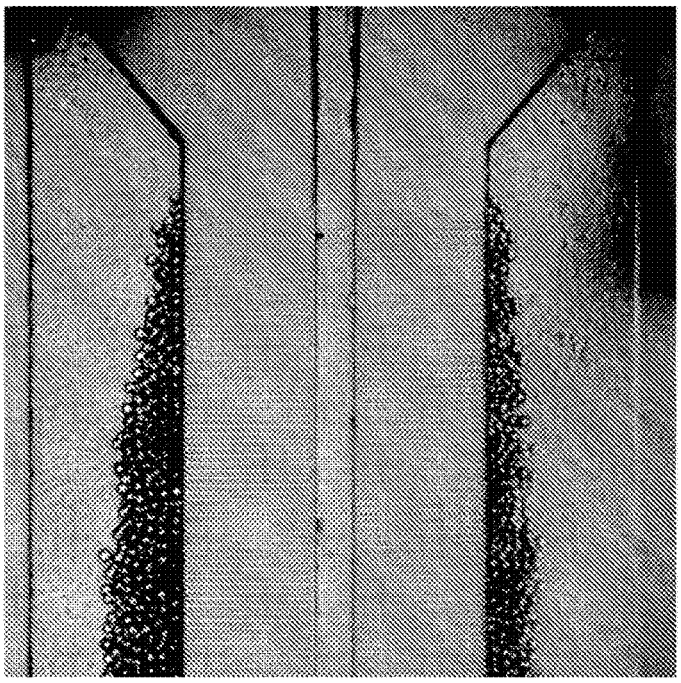
FIGS. 2A-2B are optical microscopy images of an apparatus in accordance with another embodiment of the invention.
Figure 2B:
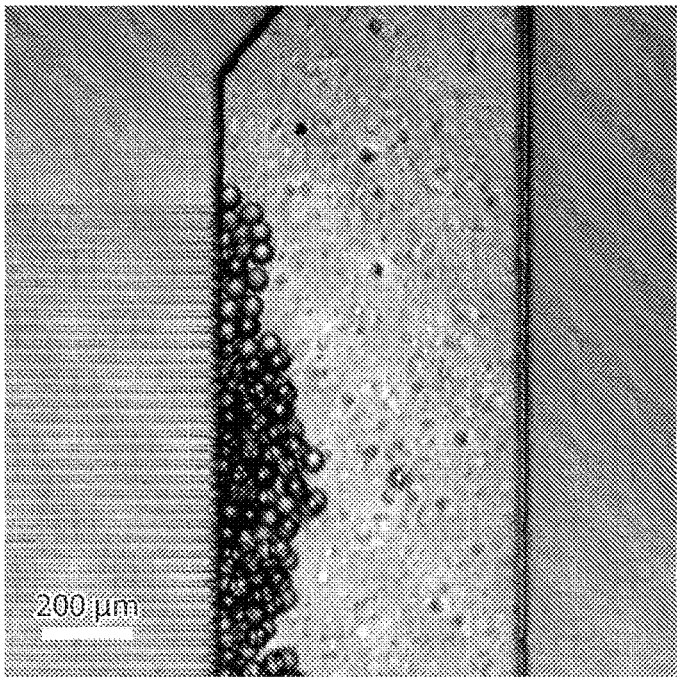

In the first example, both edges of its long axis were connected to the main channel through two times 1000 10 micrometer tall, 10 micrometer wide and 500 micrometer long channels that were localized in the middle of the z-axis of the main channel as shown in FIG. 1B. Droplets were formed at the intersection where the small channels intersect the main channel as shown in FIG. 2. Droplets exited the device through a single outlet that was localized at the end of the array of small channels as shown in FIG. 1B.

Figure 3A:
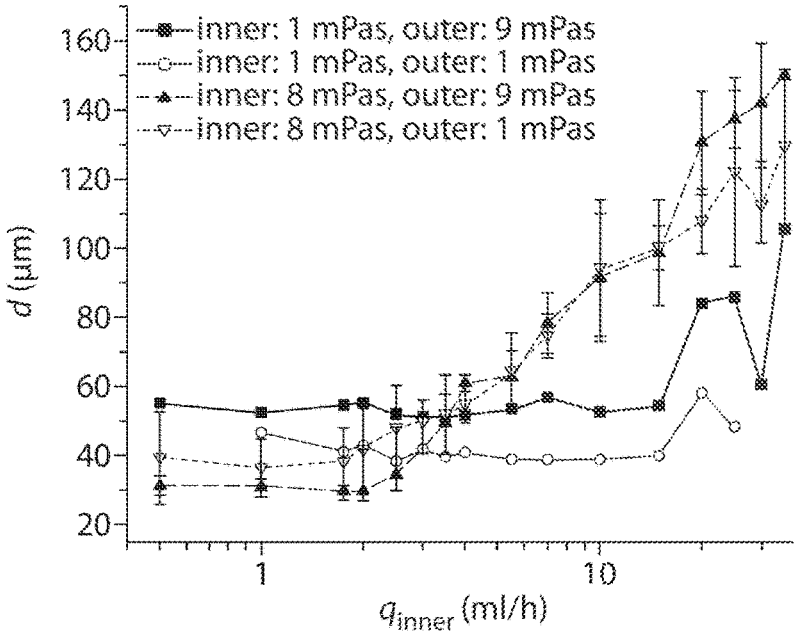
FIGS. 3A-3B illustrate control of size of droplets in some embodiments of the invention.
Figure 3B:
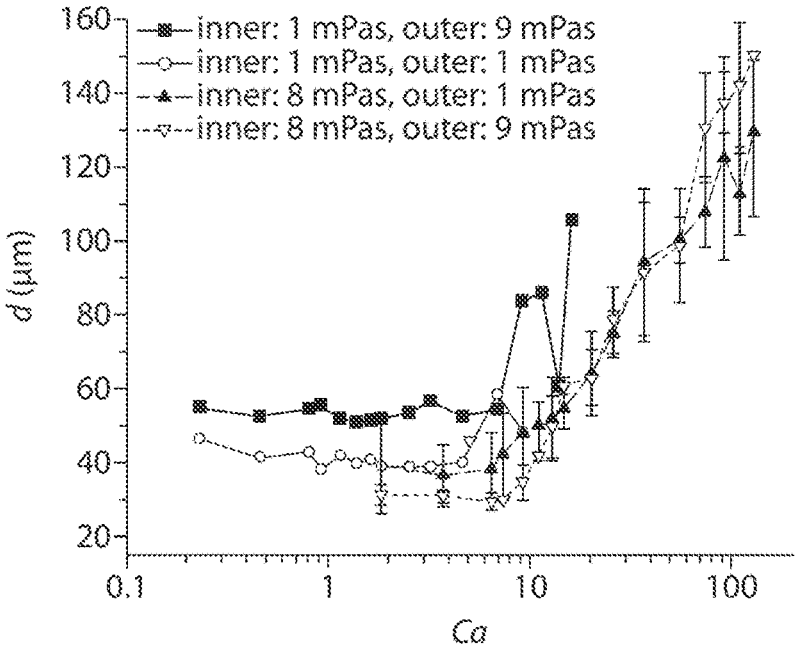

The average size of the droplets was found to depend on the viscosity of the dispersed phase and the geometry of the device. The viscosity of the continuous phase was found to only insignificantly influence the size of the droplets. By contrast, the size of the droplets increased with increasing viscosity of the dispersed phase as shown in FIGS. 3A-3B. The size of droplets was plotted as a function of the dimensionless Capillary number Ca defined as $Ca=q_{inner}\times\eta/\gamma$ where $\eta$ (eta) is the viscosity of the inner phase and $\gamma$ (gamma) the surface tension for different types of inner and outer phases with different viscosities as shown in FIG. 3B. These curves closely resembled each other, indicating that the size of droplets was influenced by the product of the flow rate of the inner phase and its viscosity.

Figure 4:
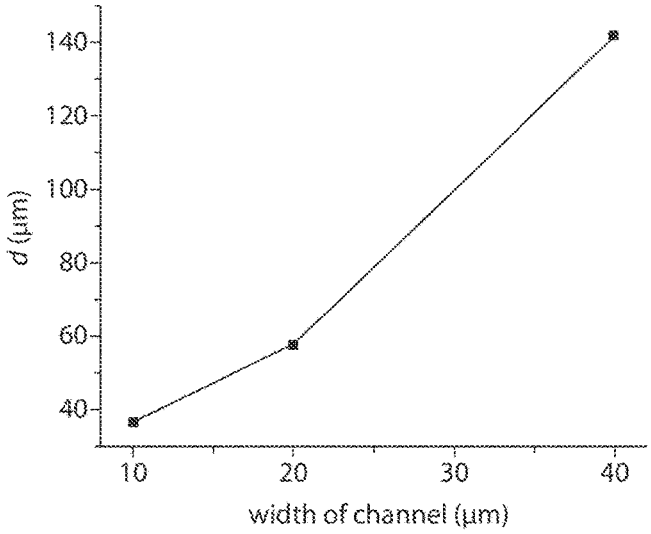
FIG. 4 illustrates a relationship between the width of the side channels and the size of droplets, in still another embodiment of the invention.
Figure 5A:
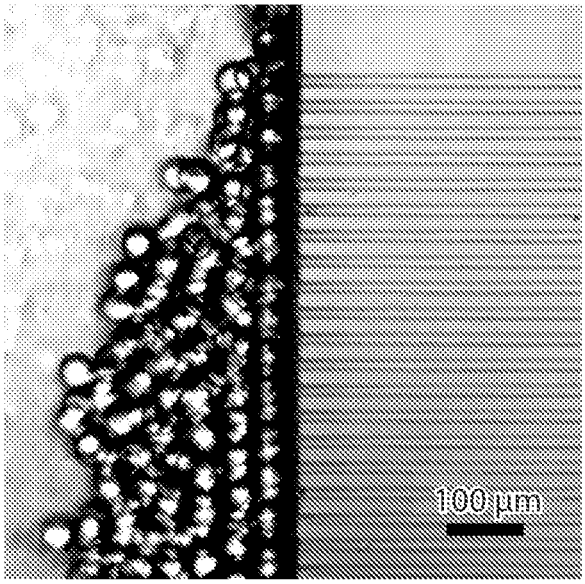
FIGS. 5A-5B illustrate droplets sizes in accordance with certain embodiments of the invention.
Figure 5B:
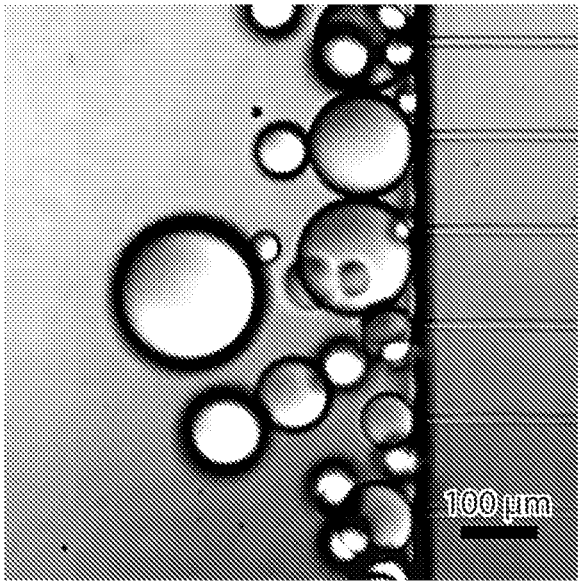
Figure 6A:
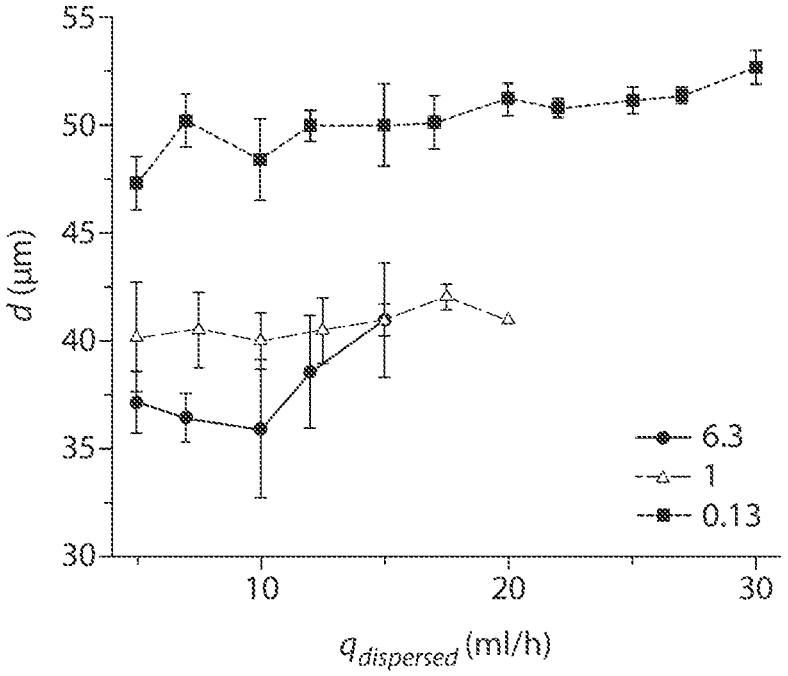
FIGS. 6A-6B illustrate the effects of flow rate on the droplets, in yet another embodiment of the invention.
Figure 6B:
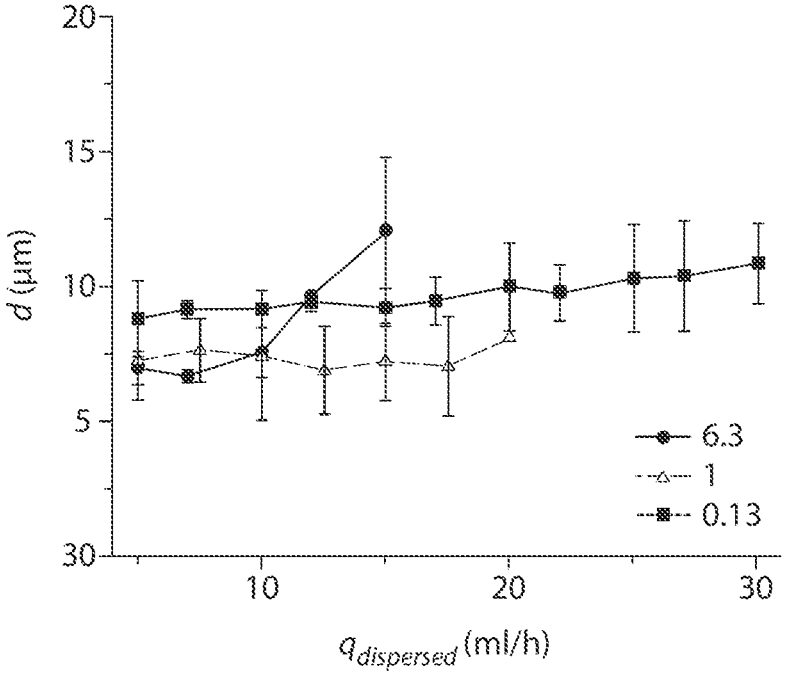
Figure 7A:
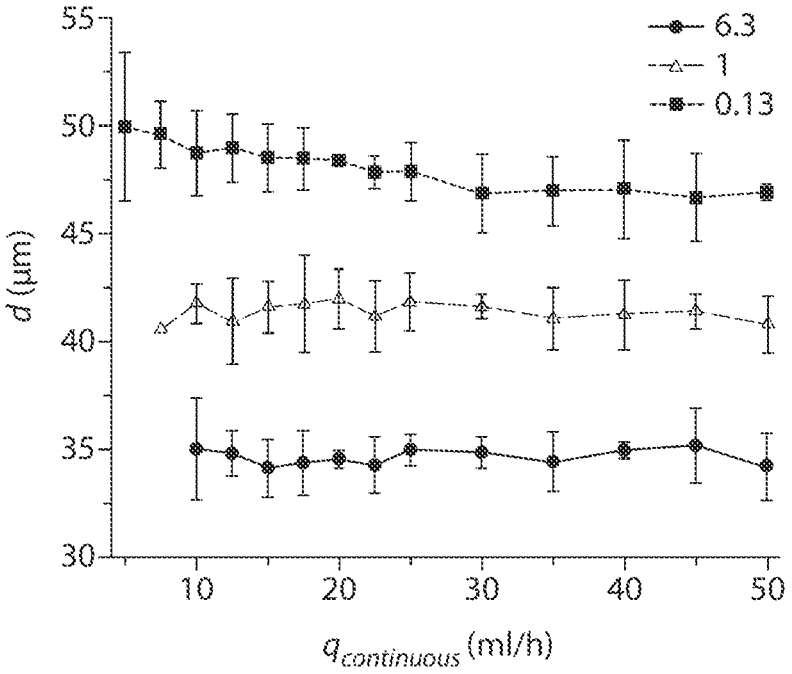
FIG. 7A-7B illustrate the effects of flow rate on the droplets, in still another embodiment of the invention.
Figure 7B:
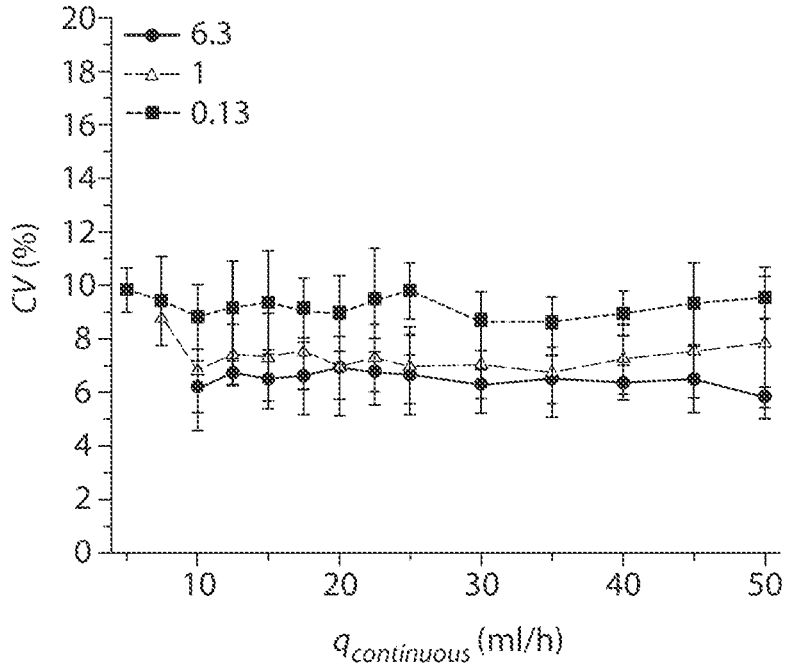

To investigate the influence of the geometry of the device on the size of droplets, the width $w_s$ of the small channel (see FIG. 1A) and the spacing between adjacent channels were varied. The size of the droplets scaled with $w_s$ as shown in FIG. 4. At higher flow rates of the inner phase, the size of droplets also depended on the spacing between adjacent channels; it increased with increasing spacing as shown in FIGS. 5A-5B. At low flow rates of the inner phase, and low viscosities of the dispersed phase, the size of the droplets was independent on the flow rates of the inner and outer phase indicating that droplets broke up through capillary wave instabilities as shown in FIGS. 6A, 6B, 7A, and 7B. At higher flow rates of the inner phase, the droplets broke up upon contact with adjacent droplets. The break-up of the droplets was believed to have been driven by a difference in the Laplace pressure caused by different curvatures in their leading and tailing ends. Differences in the curvature of the leading and tailing ends of the droplets were caused by their deformation upon contact with adjacent droplets. Thus, without wishing to be bound by any theory, it is believed that a prerequisite to form monodisperse droplets is therefore synchronized generation of droplets in the channels, as the droplets then would be homogeneously and equally deformed. The synchronization becomes increasingly more difficult with increasing spacing between adjacent channels; the polydispersity of droplets generated in devices with large spacing was significantly higher than that of droplets generated in devices with narrow spacings between adjacent channels as shown in FIGS. 5A-5B. Thus, it would be advantageous to break-up droplets within relatively smaller channels; this would allow the formation of relatively monodisperse droplets without the need for their synchronized break-up.

Figure 9A:
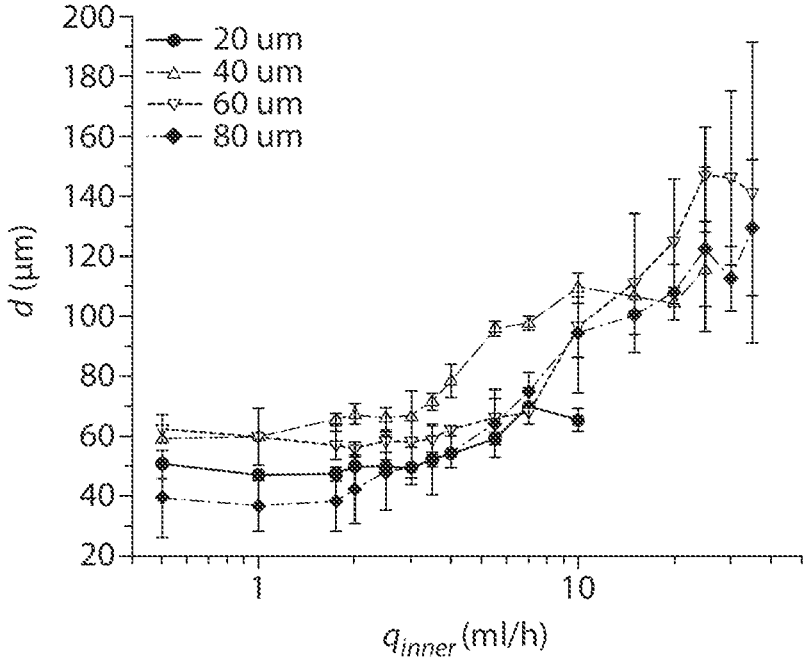
FIGS. 9A-9B illustrate control of droplet size in one embodiment of the invention.
Figure 9B:
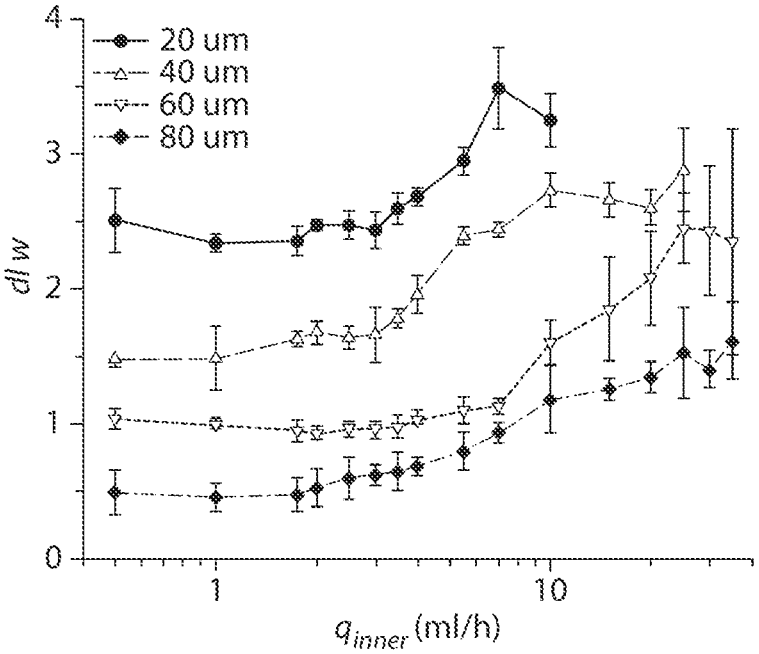
Figure 10A:
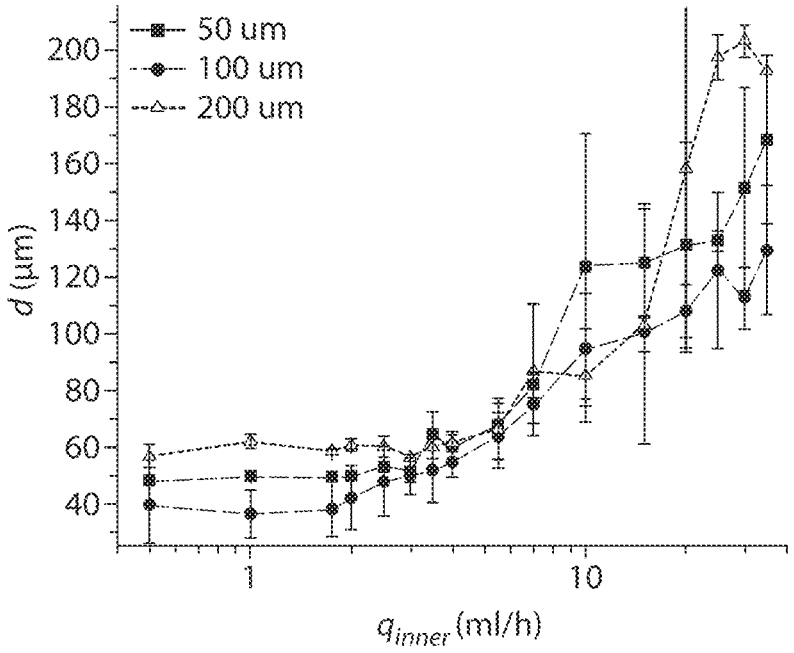
FIGS. 10A-10B illustrate control of droplet size in another embodiment of the invention.
Figure 10B:
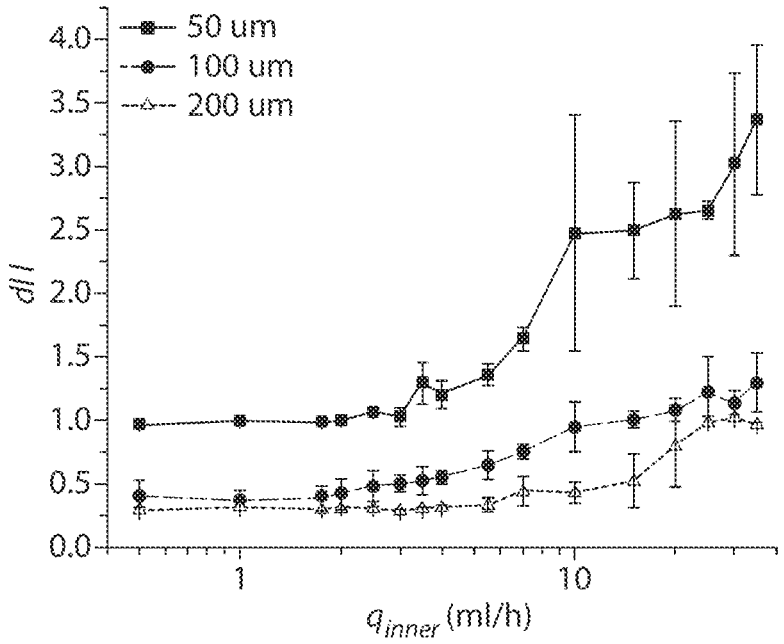

A difference in the curvature of the leading and tailing end of droplets could also be induced by deforming droplets on channel walls within the small channels; this could be induced if the small orifice of the small channels is enlarged as shown in FIG. 8. To test the influence of the geometry of the orifice on the size of droplets, the width w and height of the orifice and its length l as defined in FIG. 8 were varied. These devices contained 2×250 small channels that interconnected the large reservoir for the dispersed phase with the two large channels for the continuous phase. Furthermore, in these devices, the height of the orifice was always the same as the width w. The size of droplets was measured as a function of the flow rate of the dispersed phase while keeping the flow rate of the continuous phase constant at 20 ml/h. The width w did not significantly influence the size of droplets as shown in FIGS. 9A-9B. However, the orifice had to be at least 100 micrometers long to induce the break-up of droplets within the small channels. Devices that had orifices with l=50 micrometers produced significantly larger droplets than devices with orifices that were 100 or 200 micrometers long as shown in FIGS. 10A-10B. Furthermore, the polydispersity of droplets produced in devices with l=50 micrometers was significantly higher than that of droplets produced in devices with l greater than 100 micrometers if the flow rate of the dispersed phase was above 7.5 ml/h as indicated by the large error bars of droplets produced in devices with l=50 micrometers in FIGS. 10A-10B.

Figure 11A:
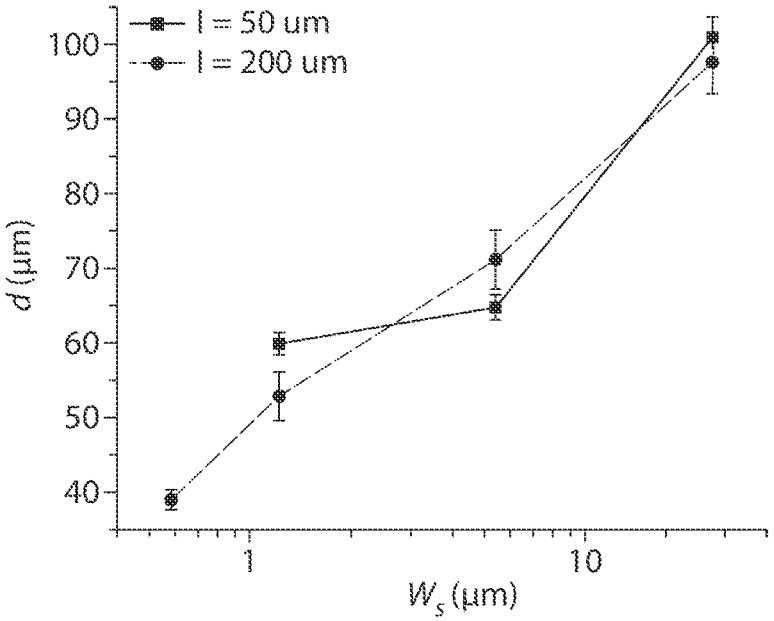
FIGS. 11A-11B illustrate control of droplet size in still another embodiment of the invention.
Figure 11B:
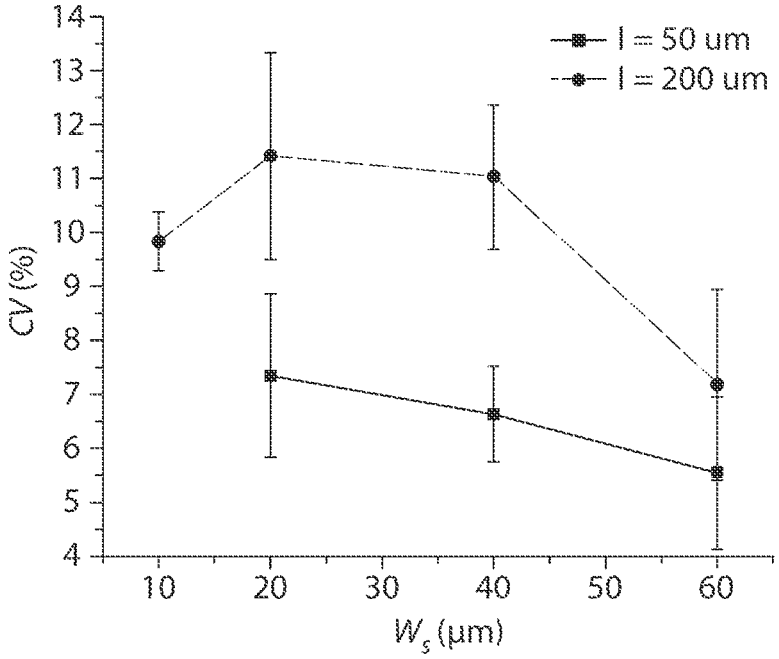
Figure 12A:
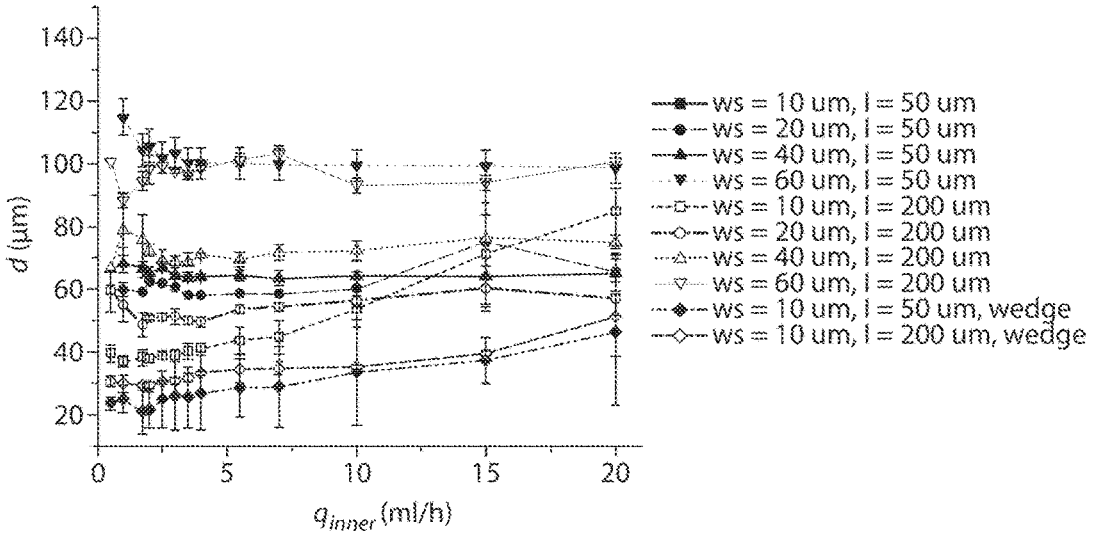
FIGS. 12A-12B illustrate control of droplet size in yet another embodiment of the invention.
Figure 12B:
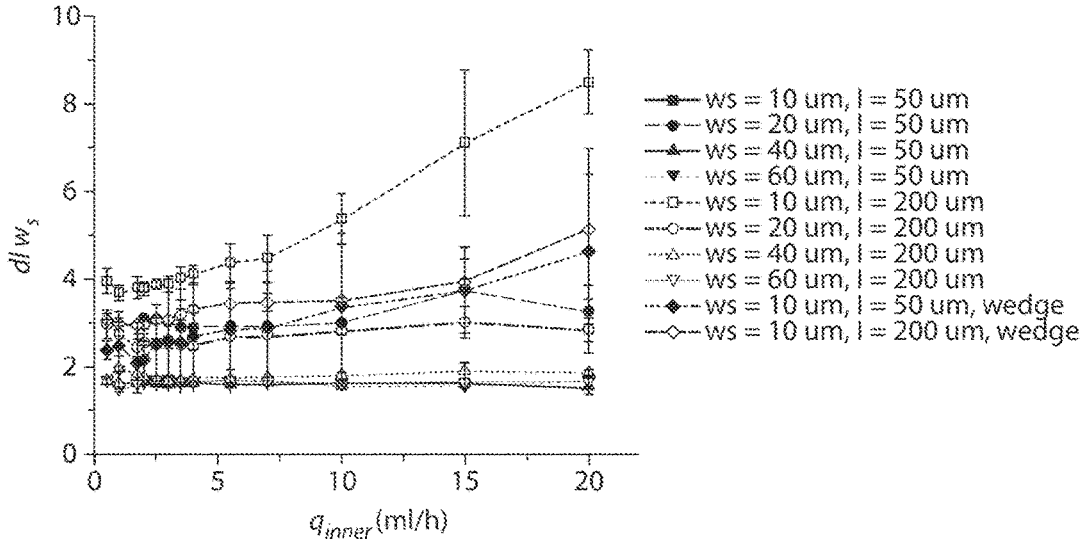
Figure 13:
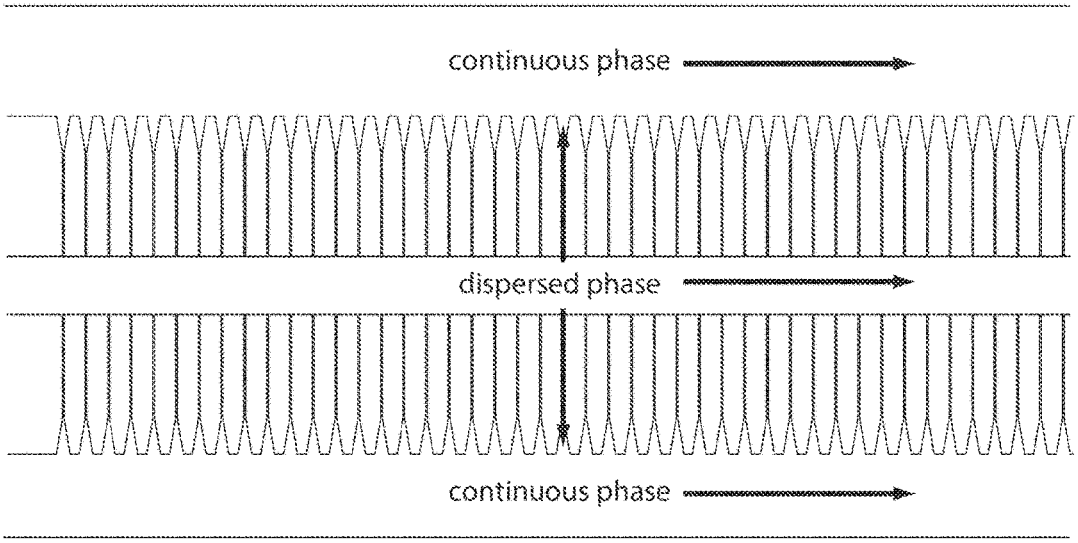
FIG. 13 illustrates a microfluidic device in yet another embodiment of the invention.

To investigate the influence of $w_s$ on the size of droplets produced in devices with orifices that were 200 micrometers long and 80 micrometers wide and tall, $w_s$ was varied between 10 and 60 micrometers. The size of the droplets scaled with $w_s$, in analogy to devices with small channels that have a constant cross section as shown in FIGS. 11A-11B. For $w_s$ greater than 10 micrometers, the size of the droplets was only weakly dependent on the flow rate of the dispersed phase as shown in FIGS. 12A-12B. This indicated that the droplets were broken up by capillary wave instabilities. By contrast, the size of micrometers produced in devices with $w_s$=10 micrometers increased with increasing flow rate of the dispersed phase. In analogy to droplets produced in devices with a constant cross section of the small channels, the coefficient of variation (CV) decreased with increasing $w_s$ as shown in FIGS. 11A-11B. The CV was defined as the standard deviation of the distribution of the droplet size σ (sigma) divided by the average size of droplets d, i.e., CV=σ/d. In addition, the top view of the orifice of the channels did not have to be squared but could also be wedge-shaped as shown in FIG. 13.

The above experiments thus illustrate different types of microfluidic devices that allow the assembly of relatively monodisperse single emulsions at high throughput rates. The average size of droplets could be closely controlled by adjusting $w_s$ of the dimensions of the small channels that interconnect the reservoir of the dispersed phase and the main channels within these devices.

EXAMPLE 2

This example illustrates a microfluidic "millipede" device that produces emulsion drops in a fundamentally new, scalable way. It can allow the production of relatively monodisperse emulsions with a throughput of, e.g., 600 ml per hour.

Contained in emulsions and gels, drops are prevalent for example in food, pharmacy, cosmetics, and agriculture. They can be made by shearing two immiscible liquids, for example through mechanical mixing, sonication, high pressure homogenization, or membrane filtration. These techniques form drops at a high throughput but offer limited control over their formation and thus typically produce polydisperse drops.

In some cases, drops can be used as vessels to conduct screening assays, as containers to perform chemical and biochemical reactions in confined volumes, and as templates to produce particles of a defined size and composition. These applications often require drops with a narrow size distribution which must be produced in a controlled way. A technique that offers an exceptionally high control over the fluid flow and thus the drop formation is microfluidics; microfluidics can produce drops with a very narrow size distribution. However, this exquisite control often comes at the expense of a low throughput. Microfluidic drop makers typically produce one drop at a time; even though they can produce up to several thousands of drops per second, the throughput can still be relatively low. In some cases, the throughput ranges between a few tens of microliters per hour for drops smaller than 50 micrometer (in diameter) up to a few ml/h for drops exceeding 100 micrometers. This may limit their use for certain applications in material science and industry.

This limitation can be addressed, for example, by parallelizing individual drop makers. If connected through distribution channels, multiple drop makers can be simultaneously operated without increasing the number of inlets for the fluids; the throughput then scales with the number of drop makers. Unfortunately, this strategy can sometimes be difficult to pursue without compromising the narrow drop size distribution as the drop size strongly depends on the velocities of the fluids. If there are slight variances in the flow rates within a parallelized device, each drop makers produces monodisperse drops, but the size of drops produced in adjacent drop makers can differ. If all the drops are subsequently collected in one single vial, their size distribution is thus broadened, thus limiting the effectiveness of this technique for certain applications. Drops can also be formed by small differences in the Laplace pressure; their size is then independent on the flow rate which makes the parallelization of these drop makers much easier. However, the drop generation frequency is limited by the small difference in the Laplace pressure, which can result in slow fluid flows.

This example illustrates the design of a device containing multiple nozzles that produce drops whose size is independent on the fluid flow rates at a high frequency. However, such a device may facilitate the high throughput production of monodisperse emulsion drops. In this example, a microfluidic device is presented. The microfluidic device is called a "millipede" device based on its general resemblance to a millipede. The device is able to produce monodisperse drops in a much more scalable way. The fluid flow at junctions in the device are caused by pressure differences induced by the growing drop. Thus, fluid flow is determined by the device geometry and fluid properties, and is relatively independent on the flow rates at which the fluids are injected. The millipede devices used in these examples contained between 500 and 1250 individual drop makers arranged on an area of 200 $mm^2$ and were used to produce highly monodisperse drops with sizes ranging from 15 micrometers up to 280 micrometers at a throughput up to 600 ml per hour, as discussed below.

Figure 16A:
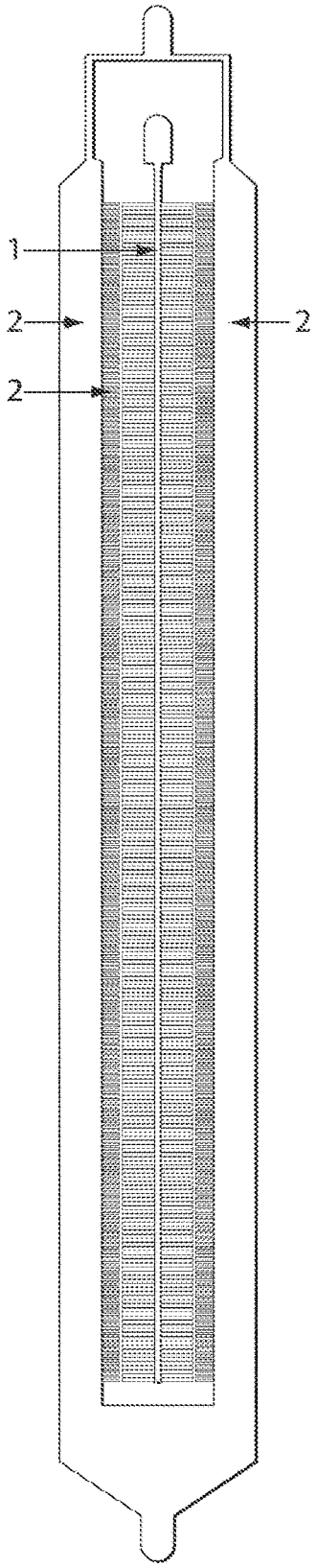
FIGS. 16A-16F illustrate an apparatus in yet another embodiment of the invention.
Figure 16B:
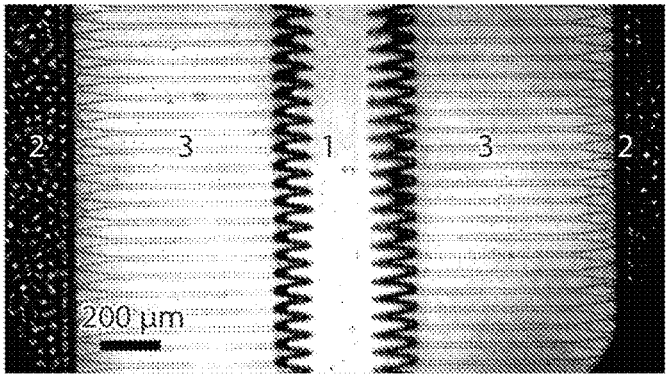
Figure 16C:
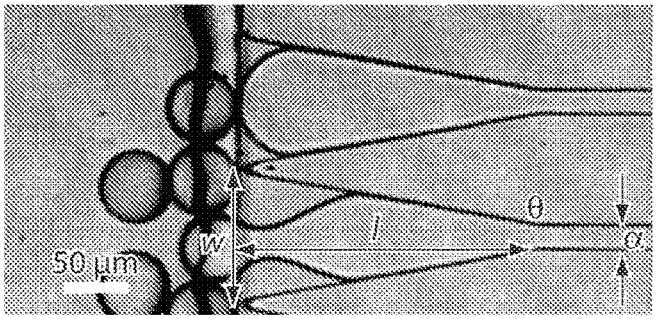

The millipede device used in this example was composed of poly(dimethyl siloxane) (PDMS) and made using soft lithography. It included one inlet for the inner phase and one inlet for the outer phase. The inlet for the inner phase guides fluid into a 175 micrometer wide, 260 micrometer tall, and 3 mm long reservoir. Parallel to both long sides of this reservoir were two 225 micrometers wide and 260 micrometers tall channels for the outer phase; they were located 950 micrometers apart from the reservoir. The channels for the dispersed and continuous phase were connected through 680 20 micrometer wide, 20 micrometer tall, and 900 micrometer long connection channels whose long axis is oriented perpendicular to the long axis of the reservoir, as shown in FIGS. 16A-B. The orifice of these channels was triangular; its length l was 231 micrometers, the angle between the channel wall of the continuous phase and the outlet of the connection channel was θ=170°, and the width of the orifice w was 100 micrometers, as shown in FIG. 16C. At the end of the outlet the channel height abruptly increased by more than an order of magnitude. The drops exited the device through a single outlet located furthest downstream the device, as shown in FIG. 16A.

The inner phase was an aqueous solution containing different amounts of poly(ethylene glycol) (PEG) ($M_w$=6 kDa) to tune its viscosity. The outer phase was a perfluorinated oil (HFE7500) containing 1% of a perfluorinated surfactant with a viscosity of 1 mPas. The inner aqueous phase was prevented from wetting by treating the channel walls with a HFE7500-based solution containing 1% perfluorinated trichlorosilane before the fluids were injected using volume controlled pumps.

Figure 16D:
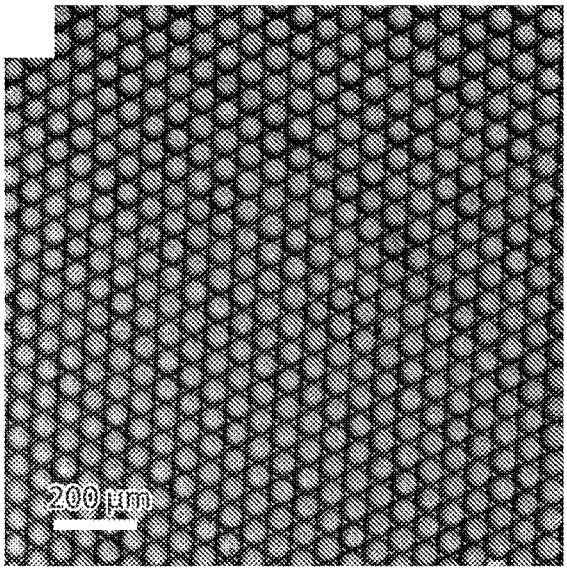
Figure 16E:
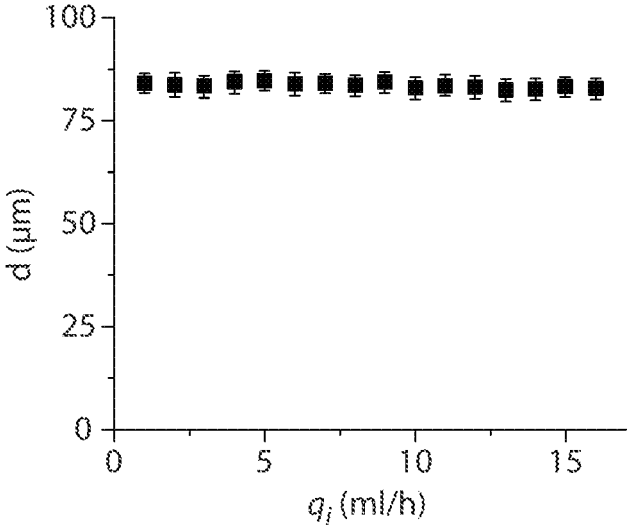
Figure 16F:
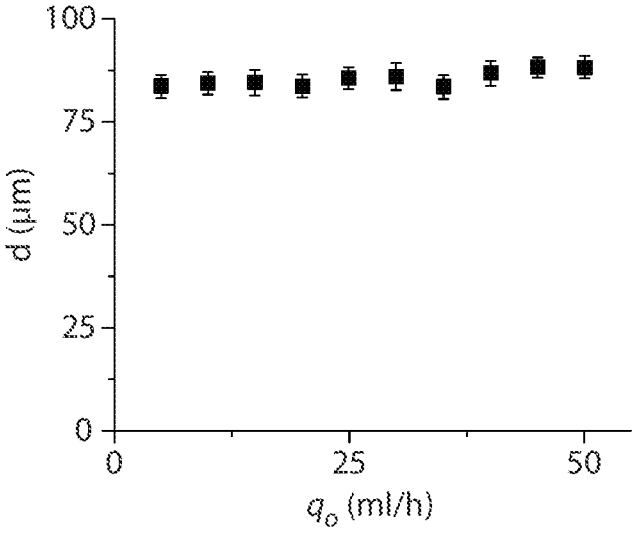

The operation of the millipede device was demonstrated by employing an aqueous solution containing 20 wt % PEG which has a viscosity of 8 mPas. Remarkably, the millipede device produced highly monodisperse drops with an average size of 60 micrometers, as shown in FIG. 16D, despite being produced by 680 different channels at a throughput as high as 10 ml/h. Indeed, the coefficient of variation (CV) of these drops, defined as the mean drop size divided by its standard deviation, was found to be as low as 3%. Such a low CV could be achieved if the drops produced in different channels had an essentially identical size. This suggested that the drop size was independent of the fluid flow rates, since it was highly unlikely that the flow rates were exactly the same throughout the entire device. To test this suggestion, the flow rate of the inner and outer phase was independently varied, and optical microscopy images of the resulting drops were acquired to measure their size. Indeed, the drop size was found to be independent of the flow rate of the inner and outer phase, as shown in FIGS. 16E-16F. This is in stark contrast to drops produced in microfluidic flow focusing junctions whose size strongly depends on the fluid flow rates.

FIG. 16A shows a schematic illustration of the millipede device. The reservoir for the inner phase is indicated with (1), the channels for the outer phase with (2) and the connecting channels with (2). FIG. 16B shows an overview and FIG. 16C shows a close-up optical micrograph of a section of the millipede device. The width of the connecting channel a, the orifice length l, width w, the angle θ (theta) are indicated. FIG. 16D shows an optical micrograph of drops produced in the millipede device at a flow rate of the inner phase of 10 ml/h. FIGS. 16E-16F shows influence of the flow rate of the inner (FIG. 16E) and outer fluid (FIG. 16F) on the drop size. The error bars indicate the standard deviation of the drop size.

Figure 17A:
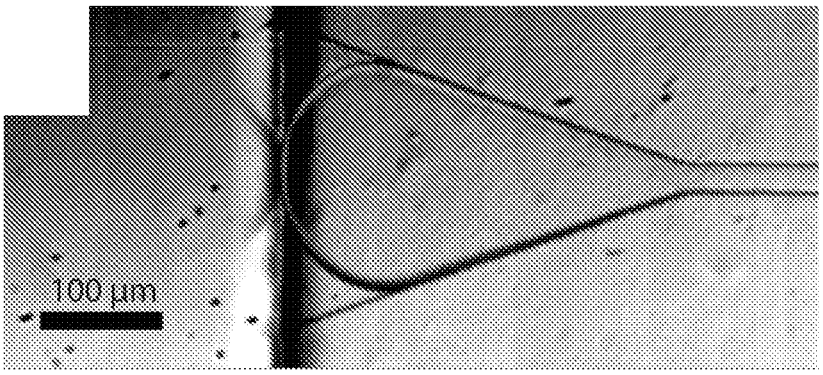
FIGS. 17A-17C shows formation of droplets, in certain embodiments of the invention.
Figure 17B:
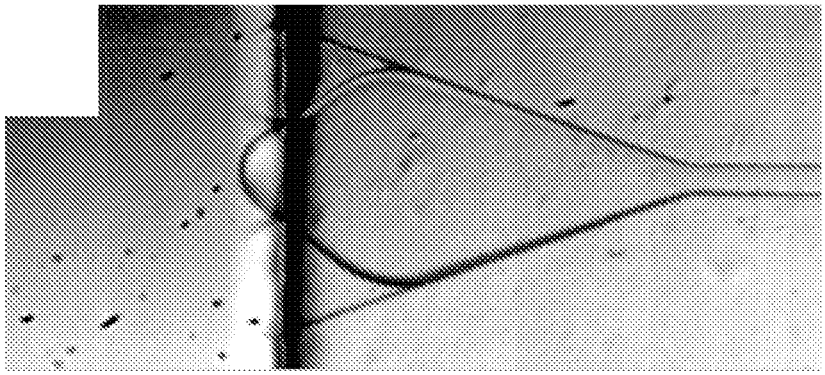

To elucidate the reason for the insensitivity of the drop size on the fluid flow rates, drop formation was monitored using a high-speed camera operated at 17 kHz. The inner phase flowed from the connecting channel into the orifice at a constant rate that was set by the flow rate of the dispersed phase. As the inner phase flowed through the orifice towards its edge it forms a semi-circular meniscus since it was a non-wetting fluid, as shown in FIG. 17A; the inner phase contained in the orifice is sometimes termed a "tongue." When the inner phase reaches the edge of the orifice, it is pushed into the large channel of the continuous phase and forms a drop by expanding in z-direction and contracting in the xy-plane to minimize its surface area, as shown in FIG. 17B.

Without wishing to be bound by any theory, it is believed that this can be explained by the following. To remain in equilibrium the total curvature $$S = \frac{1}{r_0} = \frac{1}{r_{xy}} + \frac{1}{r_z}$$

of the drop equals that of the tongue; $r_0$ is the average radius, $r_{xy}$ the radius in the plane of the orifice, and $r_z$ the radius perpendicular to the orifice. The curvature of the growing drop continuously decreased since the drop can expand in the z-direction. However the tongue cannot accommodate large changes in the surface curvature because $$r_{xy} = \frac{\frac{a}{2} + x\tan(\pi - \theta)}{\cos(\alpha)}$$

and $$r_z = \frac{2\cos(\alpha)}{h}$$

are determined by the orifice geometry; a is the width of the connecting channel, as shown in FIG. 16C, h is the channel height, α (alpha) the contact angle of the fluid with the walls and $$x = \frac{y\cos\alpha - a(1 - \sin\alpha)}{\cos\alpha + \tan(\pi - \theta)(1 - \sin\alpha)}.$$

Indeed, the surface curvature of the growing drop equals that of the tongue if the drop radius reaches a characteristic value $r_c$ which of approximately 20 micrometers; the Laplace pressure $$L_p = \frac{\gamma}{r_0} = \gamma S$$

in the drop then equals that of the tongue and the system is in equilibrium. However, as additional fluid is pushed into the orifice, more inner phase flows into the drop and increases its radius above $r_c$ which drives the system out of equilibrium. Hence, the Laplace pressure in the drop becomes smaller than that in the tongue and pulls more of the inner phase into the drop which then grows even faster. The pressure gradient between the tongue and the drop becomes even larger and further accelerates the flux of the inner phase into the drop. Indeed, the flux of the inner phase increases from almost stagnation in the first part of the orifice to very high speeds close to the edge of the orifice.

Figure 17C:
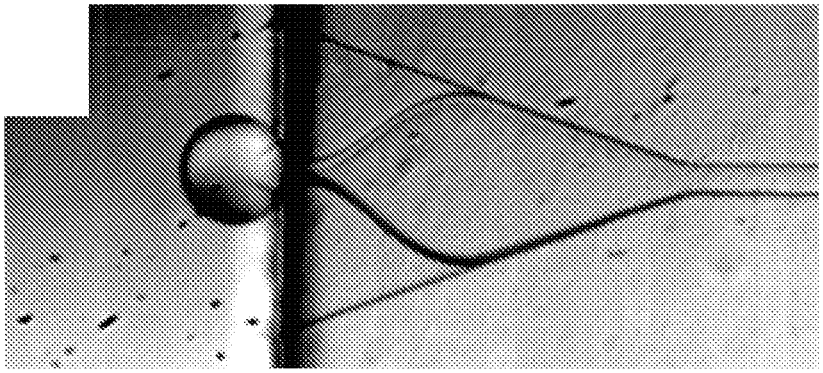

FIG. 17 shows time lapse optical micrographs of the drop formation in the millipede device (FIG. 17A) when the meniscus of the aqueous phase reaches the rim of the wedge, (FIG. 17B) 20 ms thereafter, and (FIG. 17C) 27 ms thereafter.

If the flux from the tongue into the drop exceeded that from the connecting channel into the tongue, the total volume of the tongue decreased, which caused the inner phase to neck, as shown in FIG. 17C. The decrease in the volume of the tongue reduced the pressure in the orifice and caused the outer phase to flow into the orifice. The part of the outer phase localized close to the liquid-liquid interphase turns its direction as the instability in the tongue grows and flows along this interface out of the orifice; this flow is accompanied by the pinch-off of the growing drop. Thus, during the final stages of the drop formation the fluid flow close to the orifice edge was driven by the pressure gradient between the drop and the tongue and is thus independent on the fluid flow rates at the inlets.

The pressure gradient that drives the fluid flow during the final stages of the drop formation depended on $L_p$ in the tongue whose main contribution comes from the curvature in the z-direction; it is thus strongly influenced by h. Interestingly, the drop size linearly increased with increasing h, as shown in FIG. 18, indicating that the drop size was directly related to the pressure gradient between the tongue and the growing drop. Indeed, devices with h=10 micrometers produce drops as small as 15 micrometers, albeit not as monodisperse as the larger drops, as shown in FIG. 18B. Devices with h=40 micrometers produced drops as large as 160 micrometers, as shown in FIGS. 18A and 18D, indicating that the drop size can be varied over a wide range by adjusting the orifice height.

Figure 18A:
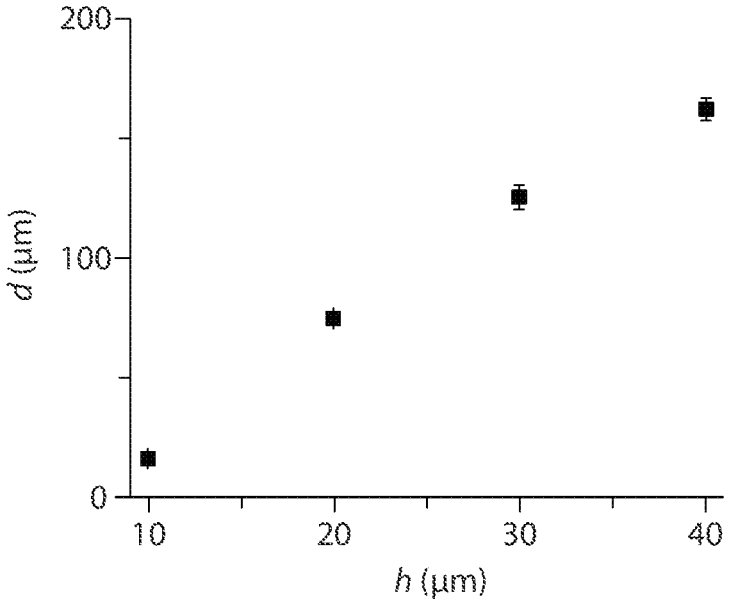
FIGS. 18A-18D illustrate the production of droplets, in some embodiments of the invention.
Figure 18B:
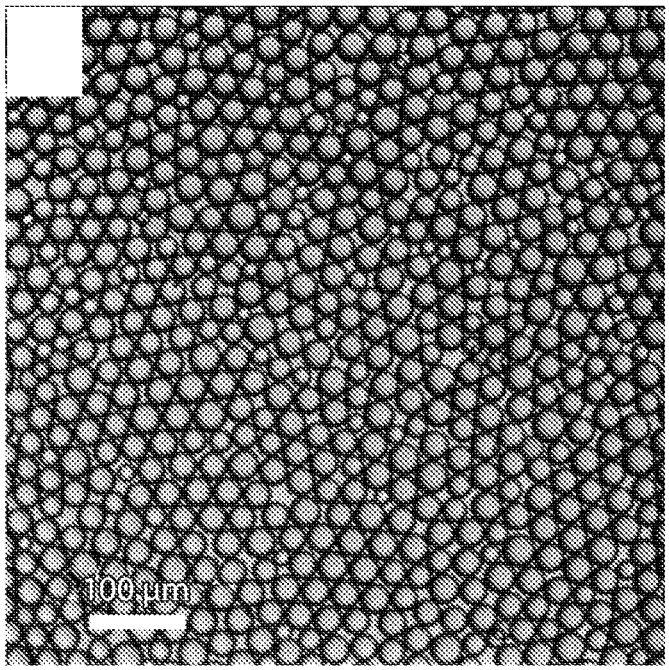
Figure 18C:
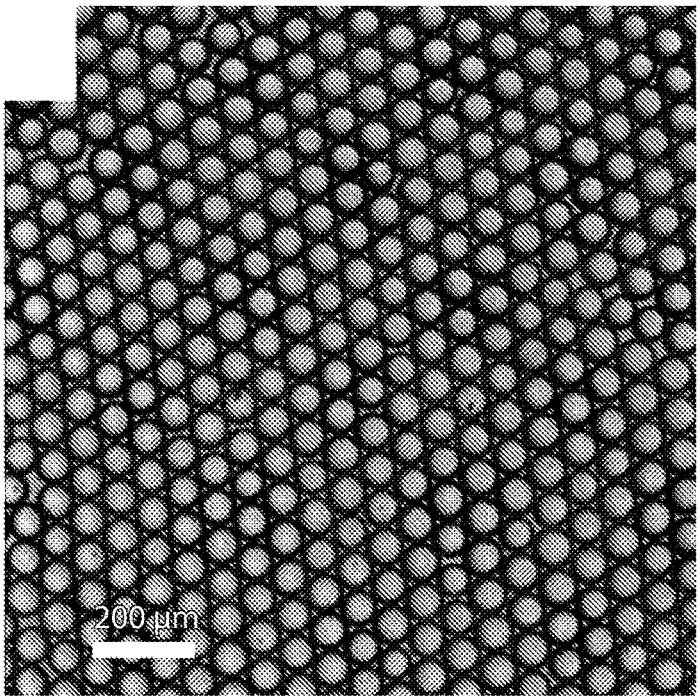
Figure 18D:
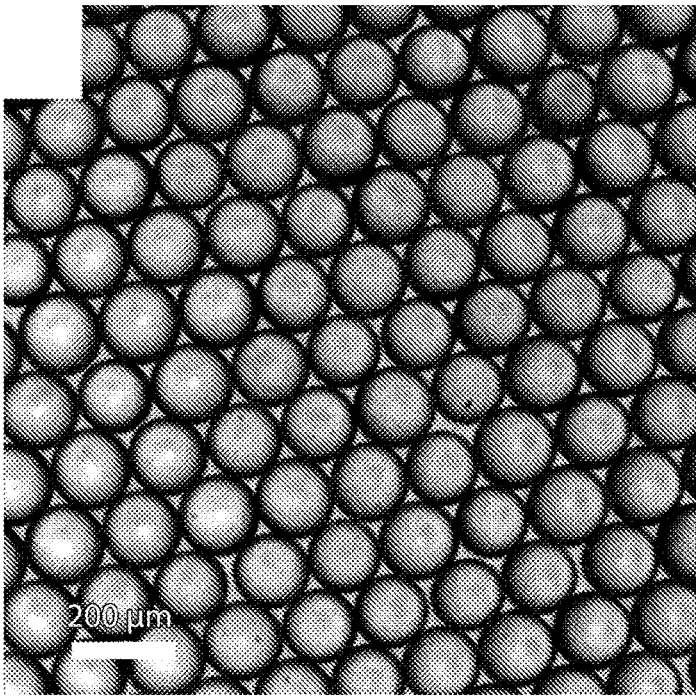

FIG. 18A shows the influence of the channel height h on the drop size. FIGS. 18B-18D are optical micrographs of aqueous drops made in devices with h=10 micrometers (FIG. 18B), 20 micrometers (FIG. 18C), and 40 micrometers (FIG. 18F). The flow rate of the inner phase was 5 ml/h (FIG. 18B), 10 ml/h (FIG. 18C), and 100 ml/h (FIG. 18D).

The Laplace pressure of the tongue also decreases with increasing θ (theta) as the curvature of the tongue in the xy-plane decreased. Indeed, the drop size increased with increasing θ (theta), as shown in FIGS. 19A-19D, corroborating the suggestion that the drop size depended on $L_p$ in the tongue. However, if θ (theta) approaches 180° and the ratio of the orifice width to its height w/h approaches unity, the velocity of the inner phase in the orifice is not significantly slowed down and the system never reaches equilibrium. Drops then break-up through a different mechanism that more closely resembles that of a membrane emulsification; this mechanism produces drops with a significantly broader size distribution. By contrast, if θ (theta) becomes too small such that the ratio of the orifice width w to h exceeds a characteristic value, the tongue becomes asymmetric and the drop break-up becomes less controlled; indeed, drops then start to break at multiple locations along the edge of the orifice which results in a broad drop size distribution, as shown in the optical micrograph in FIG. 19A and indicated by the increasing error bars in FIG. 19D.

Indeed, the drop break-up mechanism then resembles that of a step emulsification process. By analogy, h/w can also be varied by adjusting l with the same effect on the size and size distribution of drops. Too high values of l result in high ratio of h/w and a broad drop size distribution as drops then break at multiple locations along the edge of the orifice which results in a poorly controlled drop-break off and thus a broad size distribution as shown by the large error bar of the size of drops produced in devices with θ (theta)=145° and l=531 micrometers in FIG. 19E. Too low values of l result in a small ratio of h/w which does the system not allow to reach equilibrium in the initial stages of the drop formation. The drop break-up was then less controlled and drops produced in these devices were slightly larger and more importantly more polydisperse, as indicated by the considerably larger error bar in the size of drops produced in devices with θ (theta)=170° and l=131 micrometers in FIG. 19E.

Figure 19A:
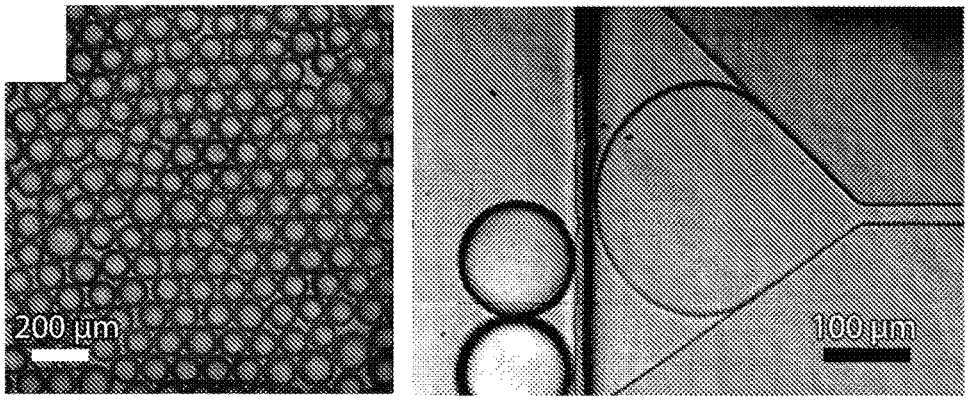
FIGS. 19A-19E illustrate the effect of pressure on droplet production, in some embodiments of the invention.
Figure 19B:
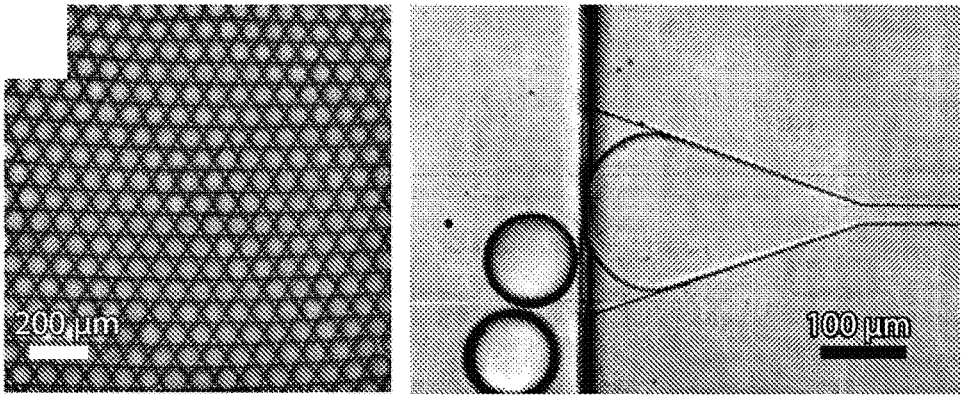
Figure 19C:
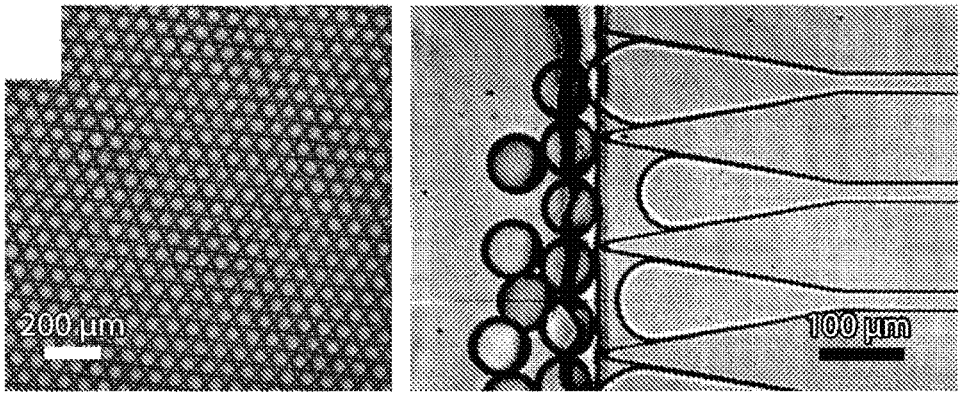
Figure 19D:
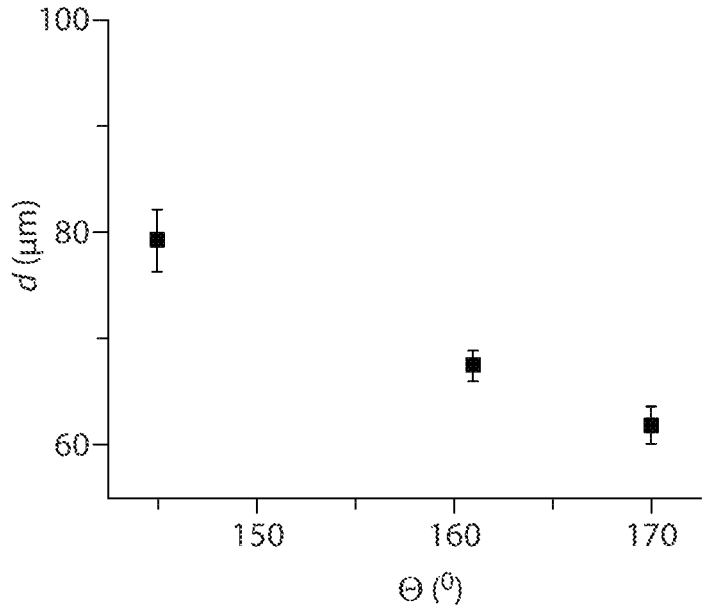
Figure 19E:
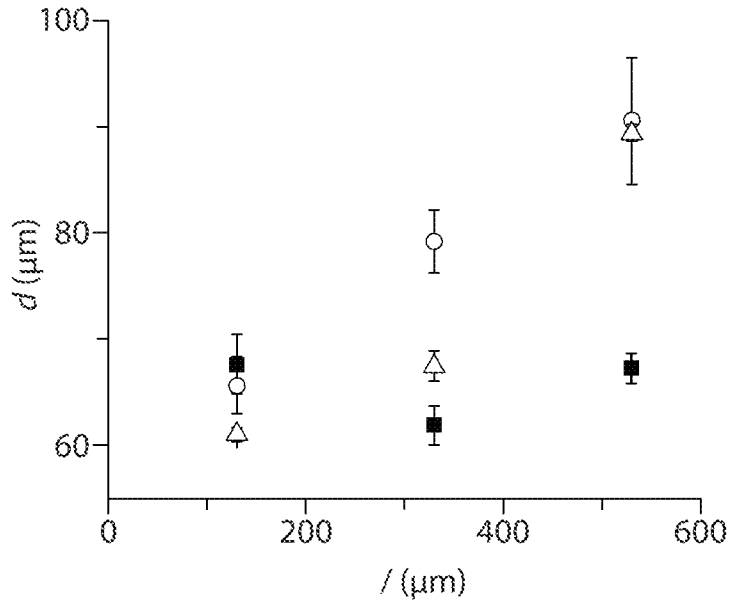

FIGS. 19A-19C show optical micrographs of drops (left) generated in a millipede device (right) with θ (theta)=145° (FIG. 19A), 161° (FIG. 19B), and 170° (FIG. 19C); l is 331 micrometers. FIG. 19D shows the drop size as a function of θ (theta). FIG. 19E shows the influence of the orifice length l on the size of drops formed in devices where the angle of the wedge was 145° (circles), 161° (triangles), and 170° (squares). The error bars correspond to the drop size distribution.

The drop size can be varied if h is adjusted. However, the ratio of h/w should remain in the range where the drop formation can be controlled. In this case, w was adjusted such that 0.15<h/w<0.25. In devices with h=10 micrometers, w was reduced to 66 micrometers; this allowed an increase in the number of drop makers contained in a millipede device with a cross-section of 200 $mm^2$ to 1250 since this number is limited by the minimum spacing of adjacent drop makers which corresponds to w. By contrast, w was increased to 160 micrometers for devices with h=40 micrometers, thus decreasing the number of drop makers contained in these devices to 500.

Figure 20A:
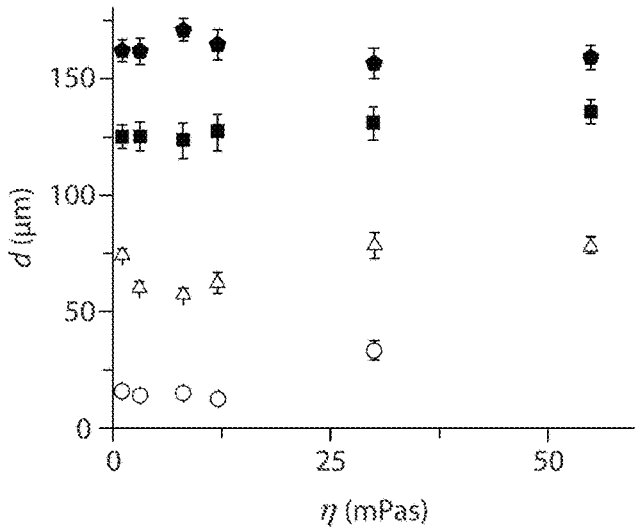
FIGS. 20A-20J illustrate the effect of viscosity on droplet production, in certain embodiments of the invention.
Figure 20B:
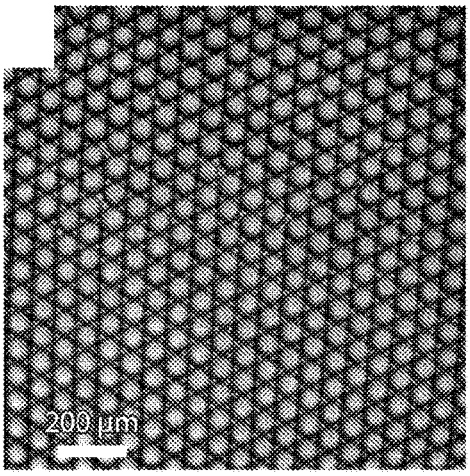
Figure 20C:
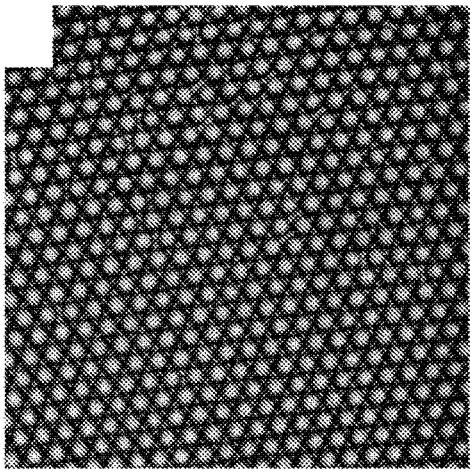
Figure 20D:
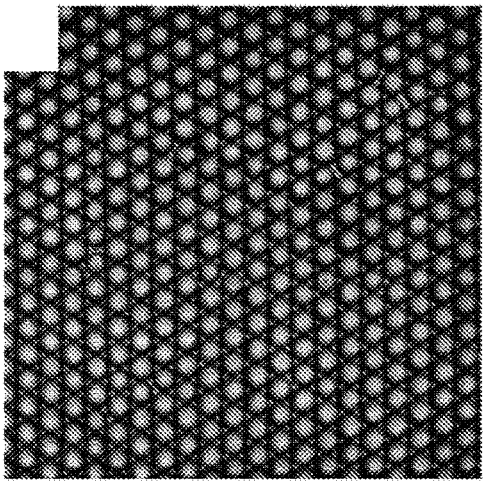
Figure 20E:
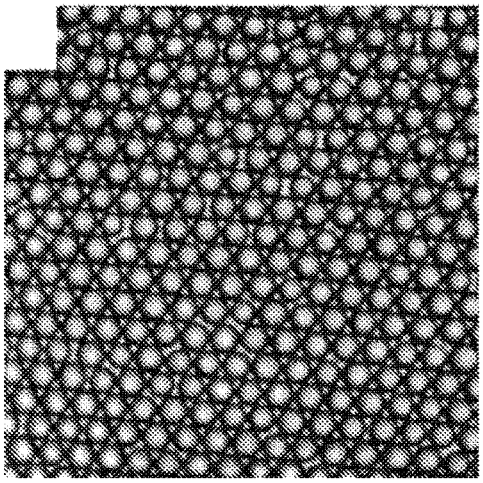
Figure 20F:
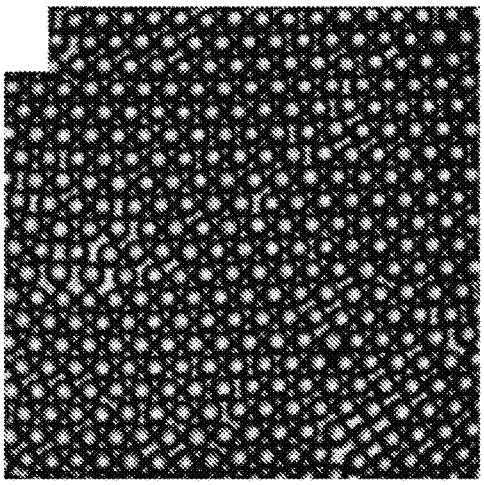

By contrast to the device geometry, the viscosity of the inner phase did not substantively affect the drop size, as shown in FIGS. 20A-20F. Remarkably, the millipede device produces very monodisperse drops even from fluids whose viscosity was up to 55 times that of water, as shown in FIGS. 20A and 20F, in contrast to conventional flow focusing devices that form long jets of these viscous liquids that typically uncontrollably break into polydisperse drops.

Figure 20G:
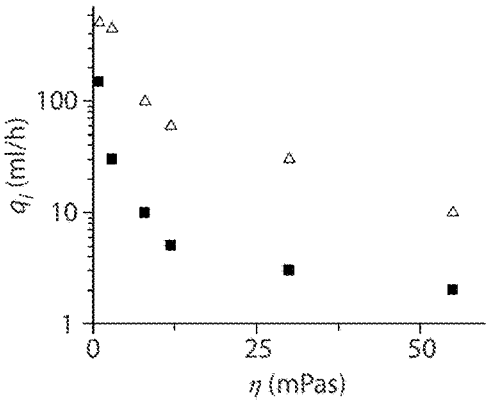
Figure 20H:
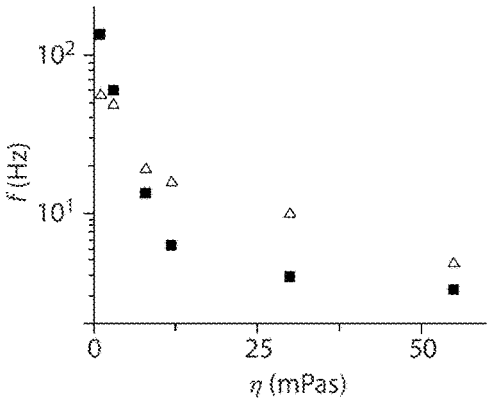

To controllably form drops the tongue may retract after drop formation and retain its equilibrium semi-circular shape during the initial stages of drop formation. This retraction becomes slower with increasing viscosity of the inner phase. Thus, the throughput of the device decreased with increasing viscosity, as shown in FIG. 20G, and so did the drop generation frequency of an individual drop maker, as shown in FIG. 20H. Drops detached from the tongue when the thread that connected them with the tongue becomes too thin and thus breaks. This happened when the flux of the inner phase from the connecting channel into the tongue was smaller than that from the tongue into the drop and thus the volume of the tongue decreased. However, if the flux of the inner phase in the connecting channel is increased above a characteristic value, e.g., by increasing the flow rate of the inner phase at its inlet, the volume of the tongue may not significantly decrease. The drop then continuously grew until it was uncontrollably sheared off either by the flow of the continuous phase or by an impacting drop. The poor control over the drop formation resulted in a very high polydispersity of the resulting drops.

Figure 20I:
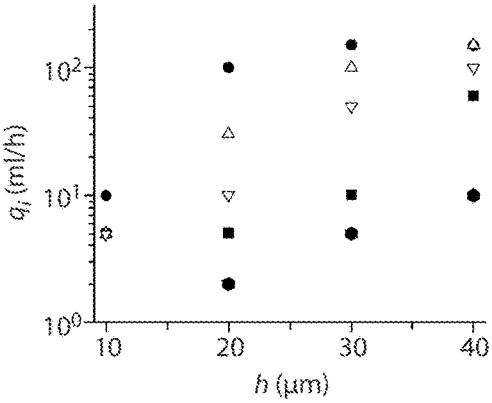

This characteristic value for the flux of the inner phase at its inlet may affect the throughput of the millipede device. However, this limit may be as high as 150 ml/h for a device with a cross-section of 200 $mm^2$ and h=40 micrometers, which is approximately two orders of magnitude higher than the throughput of a single flow focusing device. The throughput decreased with decreasing h, as shown in FIG. 20I and so did the drop generation frequency, as shown in FIG. 20. The drop generation frequency of an individual drop maker of the millipede device was approximately one order of magnitude lower than that of a flow focusing microfluidic device. The lower drop generation frequency was attributed to the completely different mechanism by which drops are formed. To controllably form drops in the millipede device, the system reaches equilibrium in the initial stages of the drop formation which may require some time but makes the drop formation very robust. The device used here was thus much more scalable and could compensate for the lower drop generation frequency by increasing the number of drop makers without compromising the monodispersity of the drops. Indeed, the density of the drop makers in a millipede device was approximately 100 times higher than that of an individual flow focusing device. Thus, despite of the lower drop generation frequency of an individual drop maker, the drop generation frequency per area is approximately 10 times higher for a millipede device compared to the flow focusing device.

Figure 20J:
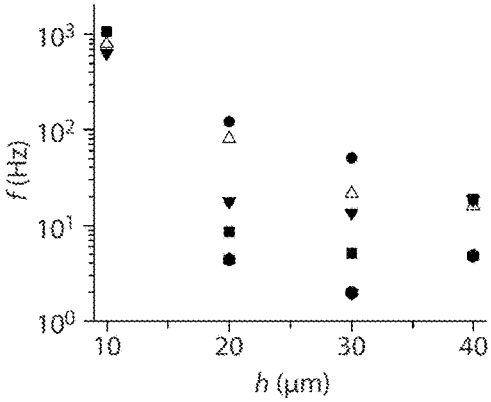

FIG. 20A shows the size of drops produced in devices with channel heights h=10 micrometers (circles), 20 micrometers (triangles), 30 μm (squares), and 40 μm (pentagons). FIGS. 20B-20G are optical micrographs of drops produced in devices with h=20 micrometers. The viscosity of the dispersed phase was 1 mPas (FIG. 20B), 3 mPas (FIG. 20C), 8 mPas (FIG. 20D), 12 mPas (FIG. 20E), 30 mPas (FIG. 20F), and 55 mPas (FIG. 20G). FIGS. 20G and 20H shows the influence of the viscosity of the inner phase on the (FIG. 20G) maximum flow rate of the inner phase and (FIG. 20H) the drop generation frequency of a single drop maker is shown. The height of the device was h=20 micrometers (squares), and 40 micrometers (triangles). The viscosity of the inner phase was 8 mPas. FIGS. 20I and 20J show the influence of the orifice height on the (FIG. 20I) maximum flow rate of the inner phase and (FIG. 20J) the drop generation frequency of an individual nozzle for an inner phase with a viscosity of 1 mPas (circles), 3 mPas (upright triangles), 8 mPas (inverted triangles), 12 mPas (squares), and 55 mPas (hexagons).

Figure 21A:
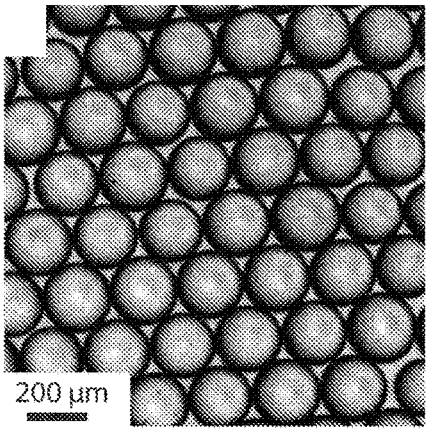
FIGS. 21A-21D illustrate droplet production in another embodiment of the invention.
Figure 21B:
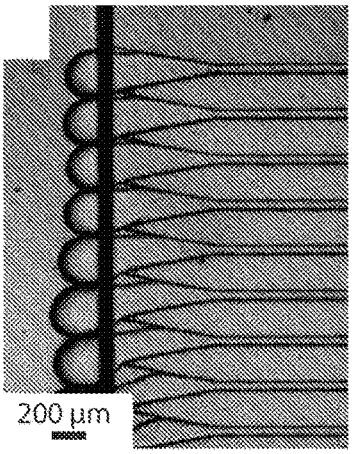
Figure 21C:
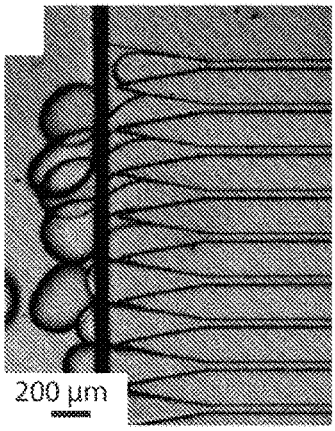
Figure 21D:
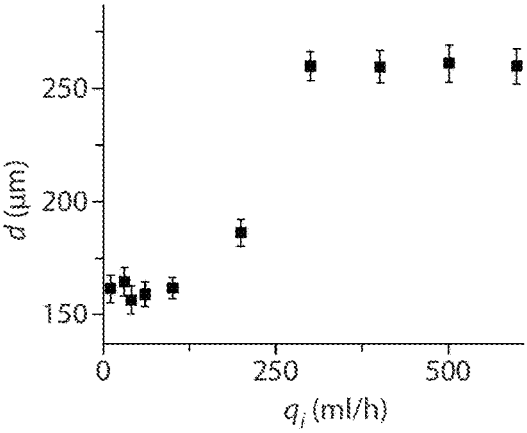
Figure 22A:
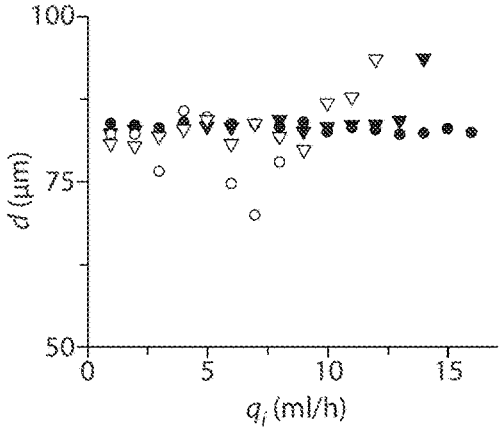
FIGS. 22A-22D illustrate the effects of flow rate, in certain embodiments of the invention.
Figure 22B:
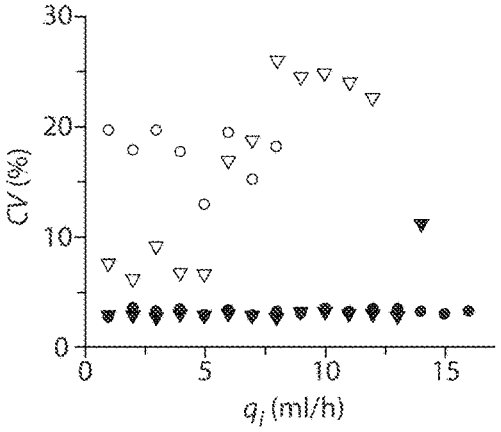
Figure 22C:
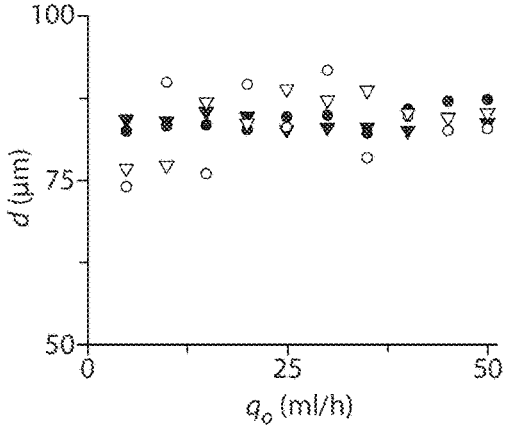
Figure 22D:
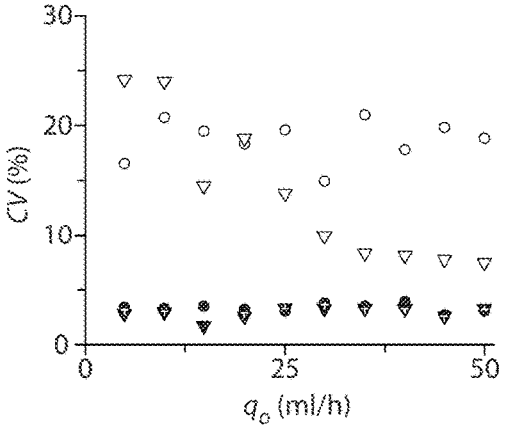

Surprisingly, drops composed of a low-viscosity fluid were very monodisperse even if produced at a throughput as high as 600 ml per hour if formed in a device with h=40 micrometers, as shown in FIG. 21A. The drop size increased from 160 micrometers if produced at flow rates of the inner phase below 150 ml/h to 260 micrometers for flow rates above 300 ml/h, as shown in FIG. 21B, suggesting that the mechanism by which drops form was different. To test this suggestion, movies were acquired with a high speed camera operated at 17 kHz. Indeed, the drops were sheared off by the continuous phase and the adjacent drops, rather than being broken up due to pressure gradients in the inner phase, as shown in FIGS. 21B-21C. Thus, the millipede device operated in the dripping regime if the flow rates are below 100 ml/h and the system is in equilibrium during the initial stages of the drop formation. By contrast, the millipede device operated in the jetting regime if the flow rates were above 300 ml/h when the system never reaches equilibrium. However, even if the millipede device is operated in the jetting regime, the drop size was independent on the flow rate of the dispersed phase once it exceeded 300 ml/h, as shown in FIG. 21D. This allowed maintaining the excellent monodispersity of the drops even if produced in the jetting regime and at this very high throughput. These results demonstrate the potential of the millipede device to produce highly monodisperse drops of different sizes at an unprecedentedly high throughput.

FIG. 21A shows an optical micrograph of the drop production in a millipede device with h=40 micrometers. The viscosity of the inner phase was 3 mPas, its flow rate was 600 ml/h, and the flow rate of the outer phase was 700 ml/h. FIGS. 21B and 21C are optical micrographs (FIG. 21B) before drops are sheared off and (FIG. 21C) while drops are sheared off. FIG. 21D shows the influence of the flow rate of the inner phase on the size of drops formed in devices with h=40 micrometers.

In addition, FIG. 22 shows the influence of the flow rate of the inner phase (FIGS. 22A-22B) and outer phase (FIGS. 22C-22D) on the size (FIGS. 22A, 22C) and size distribution (FIGS. 22B, 22D) of drops comprising an aqueous solution with a viscosity of 1 mPas (circles) and 8 mPas (triangles). The viscosity of the continuous phase is 1 mPas (filled symbols) and 10 mPas (empty symbols).

The distinctly different mechanism by which the millipede device used in this particular example produced drops makes the production of monodisperse drops scalable. Since the fluid in the orifice was driven by pressure gradients induced by the growing drop, the drop size was independent on the flow rates at which fluids were injected into the device; thus, all the drops produced with this device, starting from the very first one and ending with the very last one, were substantially identical, there was no need to equilibrate the device before monodisperse drops can be collected. Furthermore, the volume of one millipede corresponded to about 0.1 ml. If millipede devices were packed into one liter, they would produce, for example, 40 liters of 15 micrometer sized drops per hour, 80 liters of 60 micrometer sized drops, 800 liters of 160 micrometer sized drops, and as much as 4700 liters of 260 micrometer sized drops. Thus, using this device, it is possible to make monodisperse drops for products sold in quantities up to several 1000 tons per year. This millipede device has thus the potential to make microfluidics useful on a large scale.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An apparatus, comprising:

a first microfluidic channel;

a second microfluidic channel; and at least five side microfluidic channels each connecting the first microfluidic channel with the second microfluidic channel, wherein the first microfluidic channel has a cross-sectional area at least 20 times greater than the smallest cross-sectional area of the at least five side channels.

2. The apparatus of claim 1, wherein each of the at least five side channels has a length of between 90% and 110% of an average length of the side channels.

3. The apparatus of claim 1, wherein the first microfluidic channel and the second microfluidic channel have a distance of separation that is between 90% and 110% of an average distance of separation.

4. The apparatus of claim 1, wherein the at least five side channels are positioned such that the distance of separation between any neighboring side channels is between 90% and 110% of an average distance of separation between neighboring side channels.

5. The apparatus of claim 4, wherein the at least five side channels have a periodic spacing that is between 25% and 400% of a smallest cross-sectional dimension of the at least five side channels.

6. The apparatus of claim 1, wherein the at least five side channels have a periodic spacing that is between 90% and 110% of a smallest cross-sectional dimension of the at least five side channels.

7. The apparatus of claim 1, wherein the at least five side channels each connecting the first microfluidic channel with the second microfluidic channel are arranged in a linear configuration.

8. The apparatus of claim 1, wherein the smallest cross-sectional area of the at least five side channels is less than 500 micrometers$^2$.

9. The apparatus of claim 1, wherein the smallest cross-sectional area of the at least five side channels is less than 100 micrometers$^2$.

10. The apparatus of claim 1, wherein each of the at least five side channels has a cross-sectional area of between 90% and 110% of an average cross-sectional area of the side channels.

11. The apparatus of claim 1, wherein each of the at least five side channels has a volume of between 90% and 110% of an average volume of the side channels.

12. The apparatus of claim 1, wherein the first microfluidic channel has a length of at least 1 mm.

13. The apparatus of claim 1, wherein the first microfluidic channel has a cross-sectional area that varies between 90% and 110% of an average cross-sectional area.

14. The apparatus of claim 1, wherein the second microfluidic channel has a cross-sectional area that varies between 90% and 110% of an average cross-sectional area.

15. The apparatus of claim 1, wherein the second microfluidic channel comprises a droplet.

16. An apparatus, comprising:

a first microfluidic channel having a length of at least 5 mm;

a second microfluidic channel parallel to the first microfluidic channel; and at least five side microfluidic channels each connecting the first microfluidic channel with the second microfluidic channel.

17. The apparatus of claim 16, wherein the second microfluidic channel comprises a droplet.

18. A method, comprising:

flowing a first fluid in a first microfluidic channel through at least five side microfluidic channels into a second fluid contained in a second microfluidic channel, wherein the first fluid forms a plurality of droplets within the second microfluidic channel, the droplets each having a characteristic dimension of between 90% and 110% of an average characteristic dimension of the plurality of droplets.

19. The method of claim 18, wherein the plurality of droplets has a coefficient of variation of less than 20%.

20. The method of claim 18, comprising forming droplets at a rate of at least 1,000 droplets per second.

21. The method of claim 18, wherein the plurality of droplets has an average characteristic dimension of less than 1000 micrometers.

22. The method of claim 18, wherein the plurality of droplets formed within the second microfluidic channel are contained within a second fluid.

* * * * *